US006010312A

United States Patent [19]

Suitou et al.

[11] Patent Number: 6,010,312

[45] Date of Patent: Jan. 4, 2000

[54] CONTROL VALVE UNIT WITH INDEPENDENTLY OPERABLE VALVE MECHANISMS FOR VARIABLE DISPLACEMENT COMPRESSOR

[75] Inventors: Ken Suitou; Masahiro Kawaguchi; Hiroyuki Nagai; Tetsuhiko Fukanuma, all of Kariya, Japan

[73] Assignee: Kabushiki Kaisha Toyoda Jidoshokki Seiksakusho, Aichi-ken, Japan

[21] Appl. No.: 08/903,293

[22] Filed: Jul. 30, 1997

[30] Foreign Application Priority Data

Jul. 31, 1996 [JP] Japan ..... 8-202103

[51] Int. Cl.[7] ..... F04B 1/26

[52] U.S. Cl. ..... 417/222.2

[58] Field of Search ..... 417/222.2

[56] References Cited

U.S. PATENT DOCUMENTS

| | | | |
|---|---|---|---|
| 4,606,705 | 8/1986 | Parekh | 417/222.2 |
| 5,145,326 | 9/1992 | Kimura et al. | 417/222.2 |
| 5,173,032 | 12/1992 | Taguchi et al. | 417/222.2 |
| 5,332,365 | 7/1994 | Taguchi | 417/222.2 |
| 5,586,870 | 12/1996 | Kawaguchi et al. | 417/222.2 |
| 5,702,235 | 12/1997 | Hirota et al. | 417/222.2 |
| 5,785,502 | 7/1998 | Ota et al. | 417/222.2 |
| 5,842,835 | 12/1998 | Kawaguchi et al. | 417/222.2 |

FOREIGN PATENT DOCUMENTS

| | | |
|---|---|---|
| 0628722 | 12/1994 | European Pat. Off. . |
| 62-171667 | 10/1987 | Japan . |
| 5-99136 | 4/1993 | Japan . |
| 6-213149 | 8/1994 | Japan . |
| 6-346845 | 12/1994 | Japan . |
| 7-286581 | 10/1995 | Japan . |

*Primary Examiner*—Charles G. Freay
*Assistant Examiner*—Robert Z. Evora
*Attorney, Agent, or Firm*—Morgan & Finnegan, L.L.P.

[57] ABSTRACT

A control valve in a variable displacement compressor is disclosed. The compressor adjusts the discharge displacement based on control of the inclination of a swash plate located in a crank chamber. The compressor includes a supply passage for connecting a discharge chamber with the crank chamber to supply the gas from the discharge chamber to the crank chamber and a bleeding passage for connecting the crank chamber with a suction chamber to release the gas from the crank chamber to the suction chamber. The control valve includes a first valve mechanism for selectively opening and closing the supply passage, a second valve mechanism for adjusting the flow rate of the gas released from the crank chamber to the suction chamber through the bleeding passage, and a solenoid mechanism for actuating the first valve mechanism and the second valve mechanism. The first valve mechanism and the second valve mechanism operate independently. The first valve mechanism, the second valve mechanism and the solenoid mechanism are retained in a single housing.

18 Claims, 12 Drawing Sheets

CONTROL VALVE UNIT WITH INDEPENDENTLY OPERABLE VALVE MECHANISMS FOR VARIABLE DISPLACEMENT COMPRESSOR

BACKGROUND OF THE INVENTION

1. Field of the Invention

The present invention relates to displacement control valves incorporated in variable displacement compressors used in vehicle air conditioners. More particularly, the present invention pertains to a control valve having a mechanism for controlling the flow of refrigerant gas from a discharge chamber to a crank chamber and to a mechanism for controlling release of refrigerant gas from the crank chamber to a suction chamber.

2. Description of the Related Art

FIG. 12 is a diagram showing the flow of refrigerant gas in a prior art variable displacement compressor. The compressor includes a discharge chamber 121 and a crank chamber 122, which are connected to each other by a supply passage 123. The crank chamber 122 is connected to a suction chamber 124 by a bleeding passage 125. Refrigerant gas in an external refrigerant circuit 129 is drawn into the suction chamber 124 through a suction passage 128. A swash plate (not shown) is tiltably supported on a rotary shaft (not shown) in the crank chamber. Pistons are housed in cylinder bores and operably coupled to the swash plate. Each piston compresses refrigerant gas drawn into the corresponding cylinder bore from the suction chamber 124 and discharges the compressed gas to the circuit 130 via the discharge chamber 121.

An electromagnetic valve 126 is located in the crank chamber supply passage 123. The valve 126 selectively opens and closes the passage 123 for controlling the supply of refrigerant gas from the discharge chamber 121 to the crank chamber 122. A control valve 127 is located in the bleeding passage 125. The valve 127 adjusts the opening of the passage 125 in accordance with the pressure Pse in the suction passage 128 thereby controlling the amount of refrigerant gas released from the crank chamber 122 to the suction chamber 124. The pressure Pc in the crank chamber 122 is controlled by the valves 126 and 127. Adjustment of the pressure Pc in the crank chamber 122 changes the difference between the pressure Pc in the crank chamber 122 and the pressure in the cylinder bores thereby changing the inclination of the awash plate. Each piston reciprocates in the corresponding cylinder bore with a stroke in accordance with the inclination of the swash plate. The displacement of the compressor is varied accordingly.

In the above described prior art compressor, the electromagnetic valve 126 and the control valve 127 are constructed independently and located separately in different positions in the compressor. This complicates the mechanism for controlling the displacement of the compressor and increases the manufacturing cost of the compressor. Further, the compressor must have two large spaces for accommodating the two valves. This enlarges the compressor.

SUMMARY OF THE INVENTION

Accordingly, it is an objective of the present invention to provide a control valve provided in a variable displacement compressor, which valve has a simplified construction for controlling the displacement of the compressor and reduces the size of the compressor.

To achieve the above objective, the present invention provides a control valve in a variable displacement compressor that adjusts the discharge displacement based on controlling the inclination of a drive plate located in a crank chamber. The compressor includes a piston operably coupled to the drive plate and located in a cylinder bore. The piston compresses gas supplied to the cylinder bore from a suction chamber and discharges the compressed gas to a discharge chamber from the cylinder bore. The inclination of the drive plate is variable based on the pressure in the crank chamber. The compressor includes a supply passage for connecting the discharge chamber with the crank chamber to supply the gas from the discharge chamber to the crank chamber and a bleeding passage for connecting the crank chamber with the suction chamber to release the gas from the crank chamber to the suction chamber. The control valve comprises a first valve mechanism for selectively opening and closing the supply passage, a second valve mechanism for adjusting the flow rate of the gas released from the crank chamber to the auction chamber through the bleeding passage, and a single housing for retaining the first valve mechanism and the second valve mechanism. The first valve mechanism and the second valve mechanism operate independently.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A displacement control valve in a variable displacement compressor according to a first embodiment of the present invention will now be described with reference to FIGS. 1 to 5.

Figure 2:
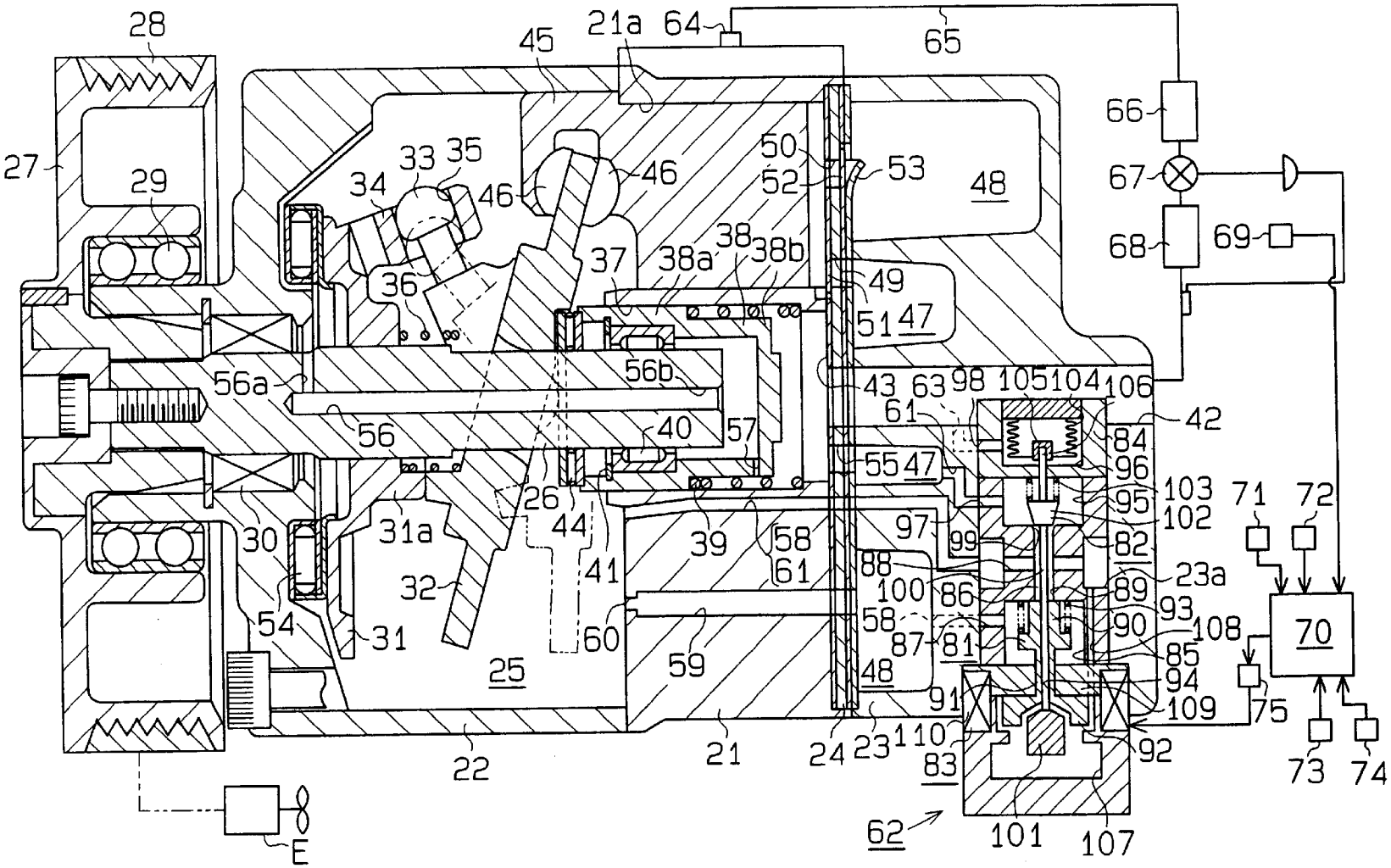
FIG. 2 is a cross-sectional view illustrating a compressor having the control valve of FIG. 1.

The construction of the variable displacement compressor will initially be described. As shown in FIG. 2, a front housing 22 is secured to the front end face of a cylinder block 21. A rear housing 23 is secured to the rear end face of the cylinder block 21 with a valve plate 24 in between. A crank chamber 25 is defined by the inner walls of the front housing 22 and the front end face of the cylinder block 21.

A rotary shaft 26 is rotatably supported in the front housing 22 and the cylinder block 21. The front end of the rotary shaft 26 protrudes from the crank chamber 25 and is secured to a pulley 27. The pulley 27 is directly coupled to an external drive source (a vehicle engine E in this embodiment) by a belt 28. The compressor of this embodiment is a clutchless type variable displacement compressor having no clutch between the rotary shaft 26 and the external drive source. The pulley 27 is supported by the front housing 22 with an angular bearing 29. The angular bearing 29 transfers thrust and radial loads that act on the pulley 27 to the housing 22.

A lip seal 30 is located between the rotary shaft 26 and the front housing 22 for sealing the crank chamber 25. The lip seal 30 prevents the gas in the crank chamber 25 from leaking out from the crank chamber.

A substantially disk-like swash plate 32 is supported by the rotary shaft 26 in the crank chamber 25 to be slidable along and tiltable with respect to the axis of the shaft 26. The swash plate 32 i provided with a pair of guiding pins 33, each having a guide ball at the distal end and being fixed to the swash plate 32. A rotor 31 is fixed to the rotary shaft 26 in the crank chamber 25. The rotor 31 rotates integrally with the rotary shaft 26. The rotor 31 has a support arm 34 protruding toward the swash plate 32. A pair of guide holes 35 are formed in the support arm 34. Each guide pin 33 is slidably fitted into the corresponding guide hole 35. The cooperation of the arm 34 and the guide pins 33 permits the swash plate 32 to rotate together with the rotary shaft 26. The cooperation also guides the tilting of the swash plate 32 and the movement of the swash plate 32 along the axis of the rotary shaft 26. As the swash plate 32 slides rearward toward the cylinder block 21, the inclination of the swash plate 32 decreases. The rotor 31 is provided with a projection 31*a* on its rear end face. The abutment of the swash plate 32 against the projection 31*a* prevents the inclination of the swash plate 32 beyond the predetermined maximum inclination.

A coil spring 36 is located between the rotor 31 and the swash plate 32. The spring 36 urges the swash plate 32 rearward, or in a direction decreasing the inclination of the swash plate 32.

Figure 3:
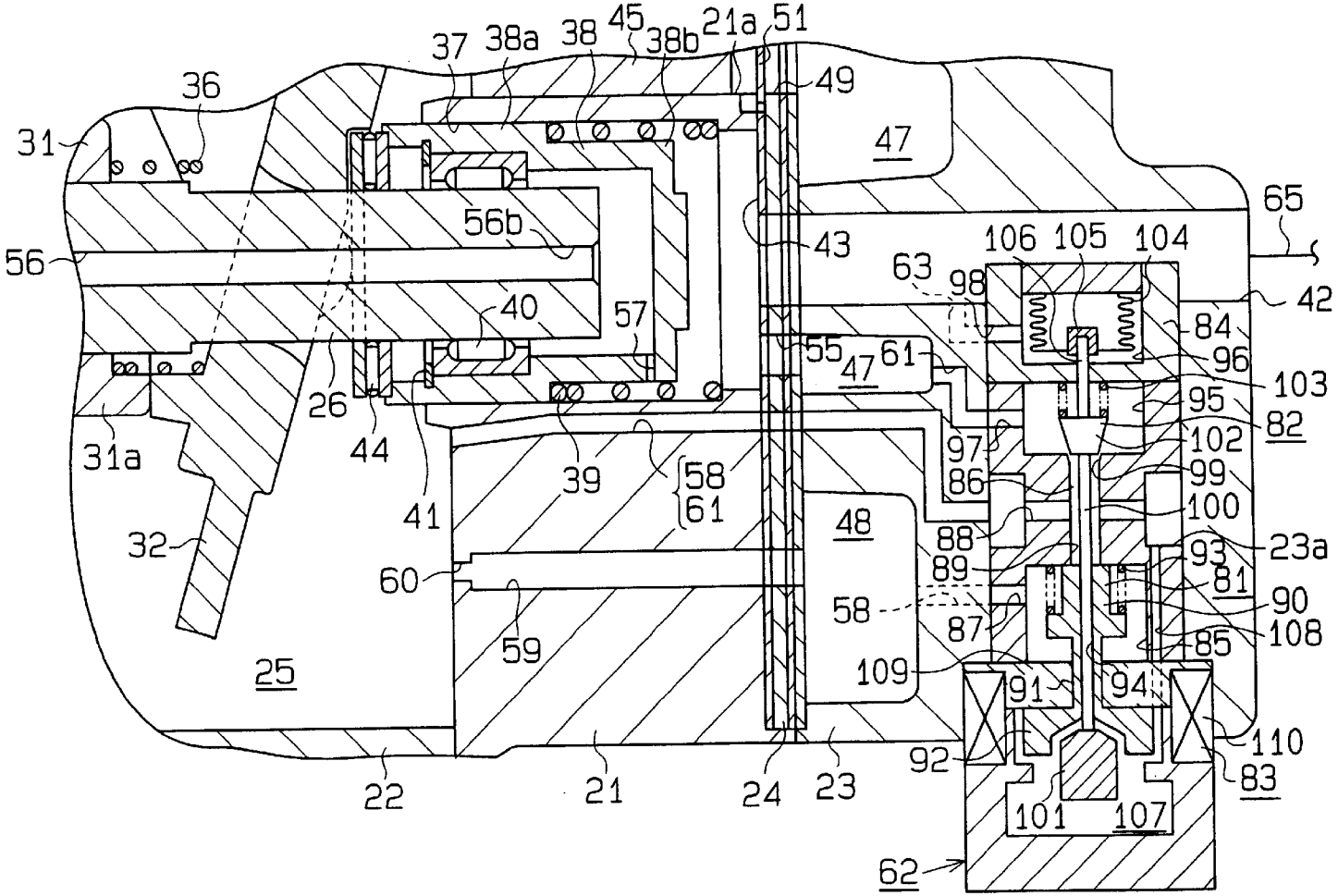
FIG. 3 is an enlarged partial cross-sectional view illustrating the compressor of FIG. 1 when the inclination of the swash plate is maximum.
Figure 4:
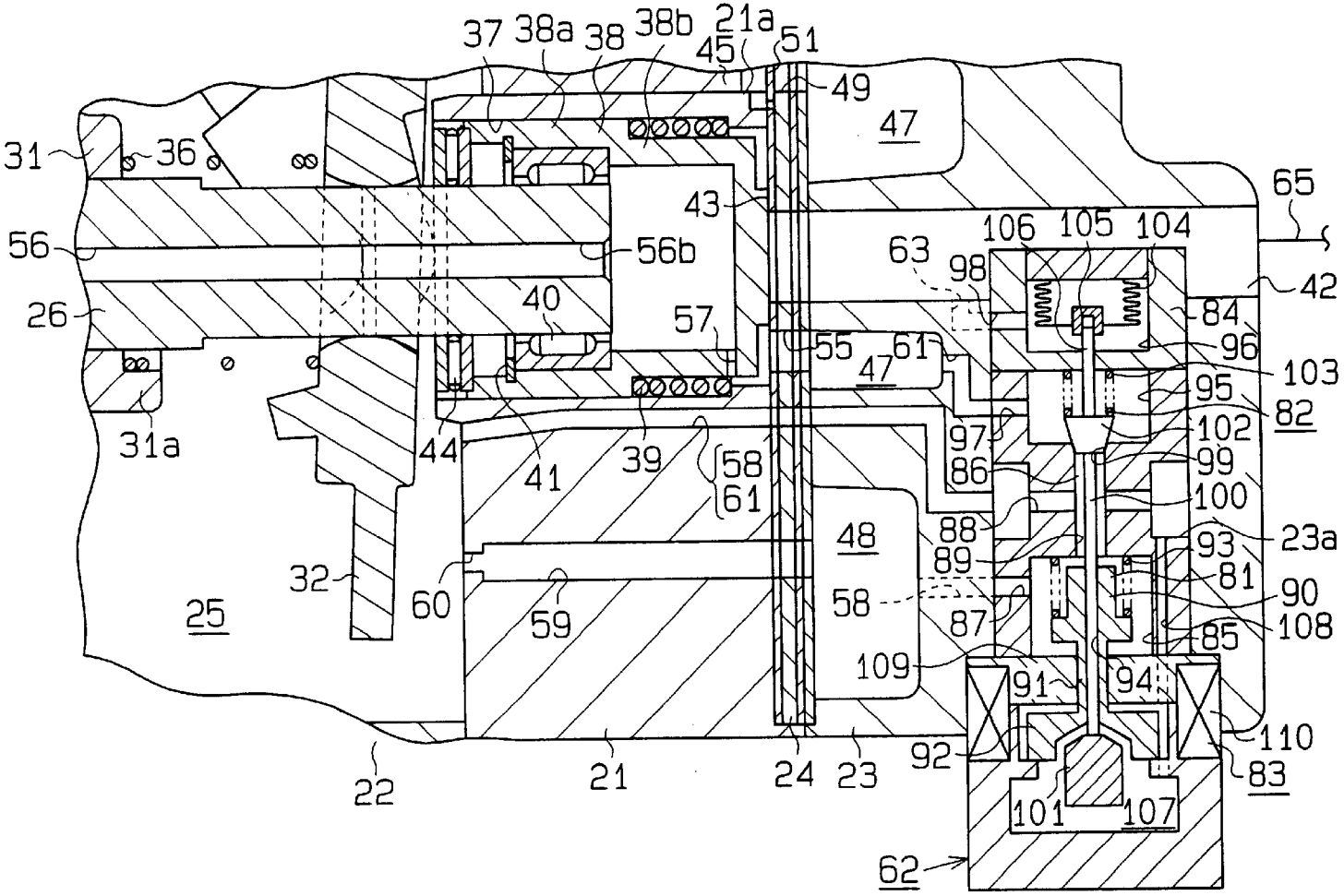
FIG. 4 is an enlarged partial cross-sectional view illustrating the compressor of FIG. 1 when the inclination of the swash plate is minimum.

As shown in FIGS. 2 to 4, a shutter chamber 37 is defined at the center portion of the cylinder block 21 extending along the axis of the rotary shaft 26. A hollow cylindrical shutter 38 having a closed end is accommodated in the shutter chamber 37. The shutter 38 slides along the axis of the rotary shaft 26. The shutter 38 has a large diameter portion 38*a* and a small diameter portion 38*b*.

The rear end of the rotary shaft 26 is inserted in the shutter 38. A radial bearing 40 is fixed to the inner wall of the large diameter portion 38*a* by a snap ring 41. Therefore, the radial bearing 40 slides with respect to the rotary shaft 26. The rear end of the rotary shaft 26 is supported by the inner wall of the shutter chamber 37 with the radial bearing 40 and the shutter 38 in between.

A coil spring 39 is located between a step, which is defined by the large diamneter portion 39*a* and the small diameter portion 38*b*, and the inner wall of the shutter chamber 37. The coil spring 39 urges the shutter 38 toward the swash plate 32. The urging force of the spring 39 is smaller than that of the spring 36.

A auction passage 42 is defined at the center portion of the rear housing 23 and the valve plate 24. The passage 42 is aligned with the axis of the rotary shaft 26 and is communicated with the shutter chamber 37. The suction passage 42 functions as a suction pressure area. A positioning surface 43 is formed on the valve plate 24 about the inner opening of the suction passage 42. The rear end of the shutter 38 abuts against the positioning surface 43. As shown in FIG. 4, abutment of the shutter 38 against the positioning surface 43 prevents the shutter 38 from further moving rearward away from the rotor 31. The abutment also disconnects the suction pasage 42 from the shutter chamber 37.

A thrust bearing 44 is supported on the rotary shaft 26 and is located between the swash plate 32 and the shutter 38 to be slidable along the axis of the rotary shaft 26. The bearing 44 is constantly retained between the swash plate 32 and the shutter 38 by the force of the coil spring 39 and prevents the rotation of the swash plate 32 from being transmitted to the shutter 38.

A plurality of cylinder bores 21*a* extend through the cylinder block 21 and are located about and parallel to the axis of the rotary shaft 26. The cylinder bores 21*a* are spaced apart at equal intervals. A single-headed piston 45 is accommodated in each cylinder bore 21*a*. A pair of semispherical shoes 46 are fitted between each piston 45 and the swash plate 32. A semispherical portion and a flat portion are defined on each shoe 46. The semispherical portion slidably contacts the piston 45 while the flat portion slidably contacts the swash plate 32. The swash plate 32 is rotated by the rotary shaft 26 through the rotor 31. The rotating movement of the swash plate 32 is transmitted to each piston 45 through the shoes 46 and is converted to linear reciprocating movement of each piston 45 in the associated cylinder bore 21*a*.

A suction chamber 47 is defined in the center portion of the rear housing 23. The suction chamber 47 is communicated with the shutter chamber 37 by a communication hole 55. A discharge chamber 48 is defined about the suction chamber 47 in the rear housing 23. Suction ports 49 and discharge ports 50 are formed in the valve plate 24. Each suction port 49 and each discharge port 50 correspond to one of the cylinder bores 21*a*. Suction valve flaps 51 are formed on the valve plate 14. Each suction valve flap 51 corresponds to one of the suction ports 49. Discharge valve flaps 52 are formed on the valve plate 24. Each discharge valve flap 52 corresponds to one of the discharge ports 50.

As each piston 45 moves from the top dead center to the bottom dead center in the associated cylinder bore 21*a*, refrigerant gas in the suction chamber 47 is drawn into each cylinder bore 21*a* through the associated suction port 49 while causing the associated suction valve flap 51 to flex to an open position. As each piston 45 moves from the bottom dead center to the top dead center in the associated cylinder bore 21*a*, refrigerant gas is compressed in the cylinder bore 21*a* until it reaches a certain pressure level. The compressed gas is discharged to the discharge chamber 48 through the associated discharge port 50 while causing the associated discharge valve flap 52 to flex to an open position. Retainers 53 are formed on the valve plate 14. Each retainer 53 corresponds to one of the discharge valve flaps 52. The opening amount of each discharge valve flap 52 is defined by contact between the valve flap 52 and the associated retainer 53.

A thrust bearing 54 is located between the front housing 22 and the rotor 31. The thrust bearing 54 carries the reactive force of gas compression acting on the rotor 31 through the pistons 45 and the swash plate 32.

A pressure release passage 56 is defined at the center portion of the rotary shaft 26. The pressure release passage 56 has an inlet 56*a*, which opens to the crank chamber 25 in the vicinity of the lip seal 30, and an outlet 56*b* that opens in the interior of the shutter 38. A pressure release hole 57 is formed in the peripheral wall near the rear end of the shutter 38. The hole 57 communicates the interior of the shutter 38 with the shutter chamber 37. The passage 56 and the hole 57 release refrigerant gas in the crank chamber 25 to the suction chamber 47.

As shown in FIGS. 2 to 5, a supply passage 58 is defined in the rear housing 23, the valve plate 24 and the cylinder block 21 for communicating the discharge chamber 48 with the crank chamber 25. Aside from the passage 58, a communicating passage 59 is defined in the valve plate 24 and the cylinder block 21 for communicating the discharge chamber 48 with the crank chamber 25. The passage 59 has a fixed restriction 60 defined at an opening next to the crank chamber 25. A bleeding passage 61 is defined in the rear housing 23, the valve plate 24 and the cylinder block 21 for communicating the crank chamber 25 with the suction chamber 47. A displacement control valve 62 is accommodated in the rear housing 23 and is located midway in the supply passage 58 and the bleeding passage 61. The supply passage 58 and the bleeding passage 61 are the same passage between the crank chamber 25 and the control valve 62. A pressure introduction passage 63 is defined in the rear housing 23 for communicating the control valve 62 with the suction passage 42. Thus, the pressure in the suction passage 42 (hereinafter referred to as a first suction pressure Pse) is communicated with the control valve 62.

As shown in FIG. 2, an outlet port 64 is formed in the cylinder block 21 and is communicated with the discharge chamber 48. The outlet port 64 is connected to the suction passage 42 by an external refrigerant circuit 65. The refrigerant circuit 65 includes a condenser 66, an expansion valve 67 and an evaporator 68. The expansion valve 67 controls the flow rate of refrigerant in accordance with the temperature of refrigerant gas at the outlet of the evaporator 68. A temperature sensor 69 is located in the vicinity of the evaporator 68. The temperature sensor 69 detects the temperature of the evaporator 69 and issue signals relating to the detected temperature to a control computer 70. The computer 70 is connected to various devices including a temperature adjuster 71, a compartment temperature sensor 72, an air conditioner starting switch 73 and a engine speed sensor 74. A passenger sets a desirable compartment temperature, or a target temperature, by the temperature adjuster 71.

The computer 70 computes a current value for the control valve 62 based on various conditions including, for example, a target temperature set by the temperature adjuster 71, the temperature detected by the temperature sensor 69, the passenger compartment temperature detected by the temperature sensor 72, an ON/OFF signal from the starting switch 73 and the engine speed detected by the engine speed sensor 74. The computer 70 transmits the computed current value to a driver 75. The driver 75 sends a current having the value transmitted from the computer 70 to a coil 110 in the valve 62. The coil 110 will be described later. The conditions for determining the current value for the valve 62 may include data other than those listed above, for example, the data may include the temperature outside of the vehicle.

The structure of the control valve 62 will hereafter be described.

Figure 1:
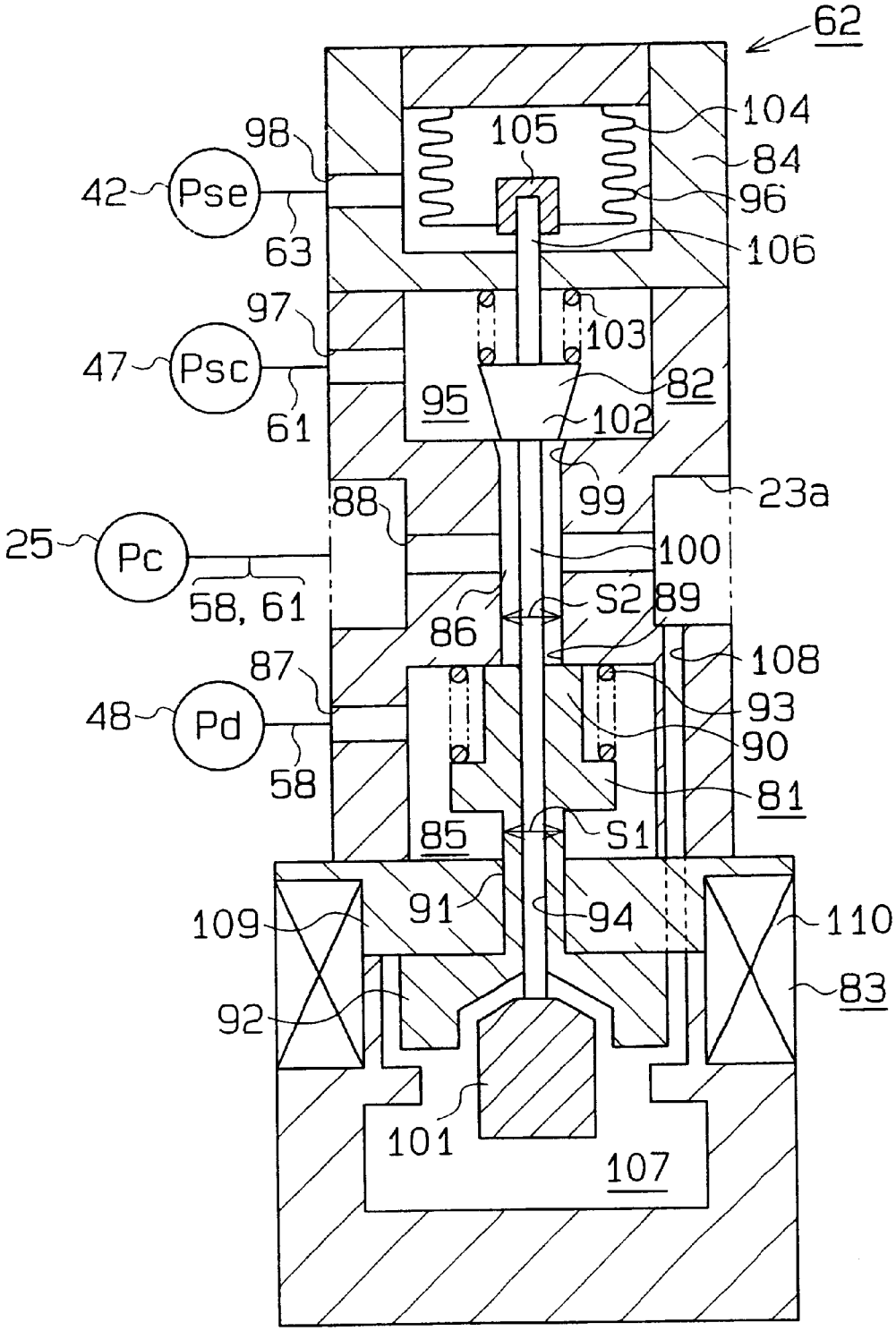
FIG. 1 is a cross-sectional view illustrating a control valve according to a first embodiment of the present invention.
Figure 5:
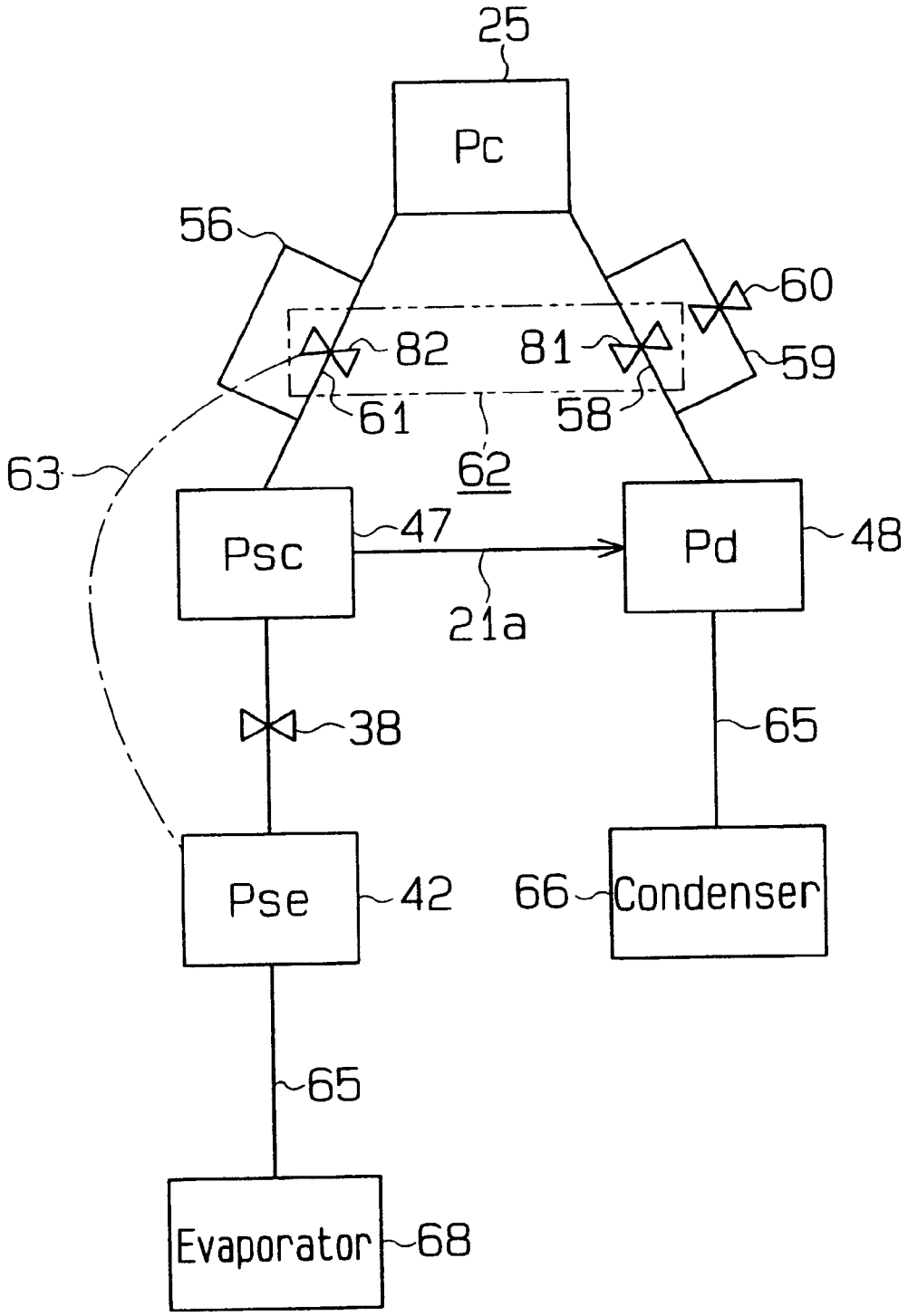
FIG. 5 is a diagram showing the flow of refrigerant gas in the compressor of FIG. 2.

As shown in FIGS. 1, 2 and 5, the control valve 62 includes a first valve mechanism 81 for selectively opening and closing the supply passage 58, a second valve mechanism 82 for controlling the opening of the bleeding passage 61 and a solenoid mechanism 83 for actuating the valve mechanisms 81, 82. The first and second valve mechanisms 81, 82 and the solenoid 83 are assembled in a single housing 84.

The first valve mechanism 81 will initially be described. The mechanism 81 includes a first valve chamber 85 and a communicating chamber 86 defined therein. The chambers 85, 86 are communicated with each other. The first valve chamber 85 is connected to the discharge chamber 48 by a supply port 87 and the supply passage 58. The pressure Pd in the discharge chamber 48 is thus communicated with the first valve chamber 85. An annular chamber 23*a* is defined by the inner wall of the rear housing 23 and the circumference of the housing 84 of the valve 62 at a position corresponding to the communicating chamber 86. The communicating chamber 86 is connected to the crank chamber 25 by a port 88 and a part of the supply passage 58, which also functions as the bleeding passage 61. The pressure Pc in the crank chamber is thus communicated with the chamber 86.

The communicating chamber 86 has a first valve hole 89 that opens to the first valve chamber 85. A first valve body 90 is movably housed in the first valve chamber 85 for selectively opening and closing the first valve hole 89. A first plunger 92 is coupled to the bottom of the valve body 90 by a rod 91. An opening spring 93 is located between the first valve body 90 and the wall of the first valve chamber 85. The opening spring 93 urges the first valve body 90 away from the first valve hole 89.

A bore 94 is defined in the center portion of the first valve body 90, the first rod 91 and the first plunger 92. The cross-sectional area S1 of the first rod 91 is substantially equal to the cross-sectional area S2 of the first valve hole 89.

The second valve mechanism 82 will now be described. The mechanism 82 has a second valve chamber 95 defined in the housing 84. The chamber 95 is communicated with the communicating chamber 86. The chamber 95 is also communicated with the suction chamber 47 by a bleeding port 97 and the bleeding passage 61. The pressure in the suction chamber 47 (hereinafter referred to as a second suction pressure Psc) is thus communicated with the chamber 95. A pressure sensing chamner 96 is defined in the housing 94 above the second valve chamber 95. The chamber 96 is communicated with the auction passage 42 by pressure sensing port 98 and the pressure introduction passage 63. The pressure Pse in the suction passage 42 is thus communicated with the pressure sensing chamber 96.

The communicating chamber 86 has a second valve hole 99 that opens to the second valve chamber 95. A second rod 100 is slidably inserted in the bore 94 of the first rod 91, which is incorporated in the above described first valve mechanism 81. A second plunger 101 is secured to the lower end of the second rod 100. The upper portion of the rod 100 extends through the communicating chamber 86 toward the second valve chamber 95. A second valve body 102 is secured to the second rod 100 in the second valve chamber 95 for controlling the opening of the second valve hole 99. A closing spring 103 extends between the second valve body 102 and the wall of the second valve chamber 95. The closing spring 103 urges the valve body 102 toward the valve hole 99.

A bellows 104, which functions as a pressure sensor, is housed in the pressure sensing chamber 96. A connecting cylinder 105 having a closed upper end is attached to the lower end of the bellows 104. A pressure sensing rod 106 protrudes upward from the top end of the second valve body 102. The upper end of the rod 106 is slidably fitted in the cylinder 105. Therefore, the bellows 104 is connected to and moved relative to the second valve body 102 by the cylinder 105 and the rod 106. The bellows 104 expands and collapses in accordance with the first suction pressure Pse introduced to the pressure sensing chamber 96 from the suction passage 42 thereby displacing the second valve body 102. The opening of second valve hole 99 is changed, accordingly.

The solenoid mechanism 83 will hereafter be described. A solenoid chamber 107 is defined in the housing 84 below the first valve chamber 85. A communicating hole 108 is formed in the housing 84 for communicating the annular chamber 23*a* with the solenoid chamber 107. Therefore, the pressure in the annular chamber 23*a* (crank chamber pressure Pc) is communicated with the solenoid chamber 107 by the bore 108.

A fixed steel core 109 is located between the solenoid chamber 107 and the first valve chamber 85. The first plunger 92 and the second plunger 101 are accommodated in the solenoid chamber 107 and face the fixed core 109. A coil 110 is wound about the core 109 and is therefore located about the plungers 92, 101. The driver 75 provides the coil 110 with current having a value computed by the computer 70.

As shown in FIGS. 1 and 2, the solenoid mechanism 83 is arranged in the lower portion of the housing 84. When the control valve 62 is built in the rear housing 23 of the compressor, the solenoid mechanism 83 is exposed to the outside of the rear housing 23. Thus, electric wires from the driver 75 may be readily connected to the coil 110 in the solenoid mechanism 83.

The operation of the above described compressor will hereafter be described.

If the switch 73 is turned on and the compartment temperature detected by the sensor 72 is higher than a target temperature set by the temperature adjuster 71, the computer 70 commands the driver 75 to excite the solenoid 83. The driver 75 then supplies the coil 110 with a current having a value computed by the computer 70 thereby producing a magnetic attractive force in accordance with the current between the core 109 and the first plunger 92 of the first valve mechanism 81. As shown in FIGS. 1 to 3, the attractive force urges the first valve body 90 against the force of the opening spring 93 in a direction closing the first valve hole 89. This closes the supply passage 58 between the discharge chamber 48 and the crank chamber 25. Supplying the coil 110 with electric current located the first valve body 90 at a position closing the first valve hole 89 regardless of the value of the current. The first plunger 92, which contacts the core 109 functions as a part of the core 109.

When the driver 75 supplies the coil 110 with a current having a value computed by the computer 70, a magnetic attractive force in accordance with the current is produced between the first plunger 92 and the second plunger 101 of the second valve mechanism 82. The attractive force is transmitted to the second valve body 102 by the second rod 100 thereby urging the second valve body 102 against the force of the closing spring 103 in a direction opening the second valve hole 99.

On the other hand, the length of the bellows 104 changes in accordance with the first suction pressure Pse in the suction passage 42 that is introduced to the pressure sensing chamber 96 by the passage 63. The changes in the length of the bellows 104 is transmitted to the second valve body 102 by the pressure sensing rod 106. The opening area between the second valve body 102 and the second valve hole 99 is determined by the equilibrium of a plurality of forces acting on the valve body 102. Specifically, the opening area is determined by the equilibrium position of the body 102, which is affected by the force of the solenoid mechanism 83, the force of the bellows 104, and the force of the closing spring 103.

As described above, when the first valve hole 89 is closed by the first valve body 90 of the first valve mechanism 81, the second valve body 102 of the second valve mechanism 82 changes the opening of the second valve hole 99 based on the equilibrium of a plurality of forces acting on the valve body 102. That is, the first valve mechanism 81 and the second valve mechanism 82 operate independently.

When the cooling load is great, the temperature in the vehicle compartment detected by the sensor 72 is significantly higher than a target temperature set by the temperature adjuster 71. The computer 70 commands the driver 75 to supply a current of greater value to the coil is 110 of the valve 62 for a greater difference between the detected temperature and the target temperature. This increases the magnitude of the attractive force between the first plunger 92 and the second plunger 101 thereby increasing the resultant force urging the second valve body 102 in a direction opening the second valve hole 99. This causes the second valve body 102 to control the opening of the second valve hole 99 in accordance with a lower first suction pressure Pse. Increasing the value of the current to the valve 62 causes the second valve mechanism 82 to maintain a lower first suction pressure Pse.

Enlarging the opening of the second valve hole 99 by the second valve body 102 increases the amount of refrigerant gas released to the suction chamber 47 from the crank chamber 25 via the bleeding passage 61. At this time, the supply passage 58 is closed by the first valve mechanism 81. This prevents the refrigerant gas in the discharge chamber 48 from being supplied to the crank chamber 25 through the supply passage 58. The pressure Pc in the crank chamber 25 is lowered, accordingly. Further, when the cooling load is great, the second suction pressure Psc in the suction chamber 47 is high. Accordingly, the pressure in each cylinder bore 21*a* is high. Therefore, the difference between the pressure Pc in the crank chamber 25 and the pressure in each cylinder bore 21*a* is small. This increases the inclination of the swash plate 32 thereby allowing the compressor to operate at a large displacement.

Maximizing the opening of the second valve hole 99 by the second valve body 102 maximizes the amount of refrigerant gas supplied to the suction chamber 47 from the crank chamber 25 through the bleeding passage 61. This results in the pressure Pc in the crank chamber 25 being substantially equal to the pressure Psc in the suction chamber 47. The inclination of the swash plate 32 thus becomes maximum as shown in FIGS. 2 and 3, and the compressor operates at the maximum displacement. The swash plate 32 is prevented from inclining beyond the predetermined maximum inclination by the abutment of the swash plate 32 and the projection 31*a* of the rotor 31.

When the compressor is operating at the maximum displacement, the discharge pressure Pd in the discharge chamber 48 often significantly increases in accordance with fluctuations of the condensing ability of the condenser 66 in the external refrigerant circuit 65. The high discharge pressure Pd is communicated with the first valve chamber 85 of the first valve mechanism 81 through the supply passage 58. The pressure Pd thus acts on the first valve body 90.

In the control valve 62 according to this preferred embodiment, the cross-sectional area S1 of the first rod 91, which connects the first valve body 90 with the first plunger 92, is substantially equal to the cross-area S2 of the first valve hole 89. When the first valve body 90 closes the first valve hole 89, the discharge pressure Pd acts on the surface of the first valve body 90, except for the part to which the first rod 91 is coupled and the part facing the first valve hole 89. Specifically, when the first valve hole 89 is closed by the first valve body 90, the force component from the discharge pressure Pd that urges the first valve body 90 in a direction closing the first valve hole 89 is substantially equal to the force component from the discharge pressure Pd that urges the valve body 90 in a direction opening the first valve hole 89, Thus, the discharge pressure Pd has no net affect. The discharge pressure Pd does not affect the movement of the first valve body 90. This allows the first valve body 90 to be accurately controlled.

If the cooling load is small, the difference between the compartment temperature detected by the sensor 72 and the target temperature set by the temperature adjuster 71 is small. The computer 70 commands the driver 75 to decrease the current value to the coil 110 of the valve 62 for a smaller difference between the detected temperature and the target temperature. This decreases the magnitude of the attractive force between the first plunger 92 and the second plunger 101 thereby decreasing the resultant force urging the second valve body 102 in a direction opening the second valve hole 99. This increases the value of the first suction pressure Pse that will open the second valve hole 99. Decreasing the value of the current to the second valve mechanism 82 causes the mechanism 82 to maintain a higher first suction pressure Pse.

Decreasing the opening of the second valve hole 99 by the second valve body 102 reduces the amount of refrigerant gas released to the suction chamber 47 from the crank chamber 25 through the bleeding passage 61. This results in a higher pressure Pc in the crank chamber 25. Further, when the cooling load is small, the second suction pressure Psc in the suction chamber 47 is low. Accordingly, the pressure in each cylinder bore 21*a* is low. Therefore, the difference between the pressure Pc in the crank chamber 25 and the pressure in each cylinder bore 21*a* is large. This decreases the inclination of the swash plate 32 so that the compressor operates with a small displacement.

As cooling load approaches zero, the temperature of the evaporator 68 in the refrigerant circuit 65 drops to a frost forming temperature. When the temperature sensor 69 detects a temperature that is lower than the frost forming temperature, the computer 70 commands the driver 75 to de-excite the solenoid 83. The driver 75 stops sending current to the coil 110, accordingly. This eliminates the magnetic attractive force between the core 109 and the first plunger 92 and magnetic attractive force between the first plunger 92 and the second plunger 101.

The first valve body 90 is then moved in a direction opening the first valve hole 89 by the force of the opening spring 93 as shown in FIG. 4. This opens the supply passage 58 between the discharge chamber 48 and the crank chamber 25. The second valve body 102, on the other hand, is moved to a position closing the second valve hole 99 by the force of the closing spring 103. This closes the bleeding passage 61 between the crank chamber 25 and the suction chamber 47. Thus, a significant amount of highly pressurized gas in the discharge chamber 48 is supplied to the crank chamber 25 by the supply passage 58. Consequently, the pressure Pc in the crank chamber 25 is further raised, accordingly. Therefore, the inclination of the swash plate 32 is minimized as shown in FIG. 4. The compressor thus operates at the minimum displacement.

When the switch 73 is turned off, the computer 70 commands the driver 75 to de-excite the solenoid mechanism 83. This also minimizes the inclination of the swash plate 32.

When the solenoid mechanism 83 is de-excited, if the first suction pressure Pse in the suction passage 42 is increased, the high pressure Pse is introduced to the pressure sensing chamber 96 by the pressure introduction passage 63. The pressure Pse causes the bellows 104 to collapse. The collapsing direction of the bellows 104 is opposite to the direction in which the closing spring 103 urges the second valve body 102. However, in this preferred embodiment, the distal end of the pressure sensing rod 106 protruding from the second valve body 106 is slidably received by the connecting cylinder 105 fixed to the bellows 104. This allows the second valve body 102 and the bellows 104 to move relative to one another. Therefore, when the solenoid mechanism 83 is de-excited and the first suction pressure Pse is high, the second valve body 102 and the bellows 104 are moved away from each other. The length change of the bellows 104 is thus not transferred to the second valve body 102. The second valve body 102 is not affected by the high first suction pressure Pse. That is, de-exciting the solenoid mechanism 83 moves the valve body 102 to the position closing the second valve hole 99 even if the first suction pressure Pse is high.

As described above, the first valve mechanism 81 in the control valve 62 selectively opens and closes the supply passage 58 in accordance with exciting and de-exciting of the coil 110 of the solenoid mechanism 83. The second valve mechanism 82 controls the opening of the bleeding passage 61 in accordance with the value of current supplied to the coil 110. More specifically, when the value of the current to the coil 110 is increased, the opening area of the second valve hole 99 is closed by a lower first suction pressure Pse. When the value of the current to the coil 110 is decreased, on the other hand, the opening area of the valve hole 99 is closed by a higher first suction pressure Pse. The compressor controls the inclination of the swash plate 32 to adjust its displacement thereby maintaining a target first suction pressure Pse. That is, the valve 62 changes the target value of the first suction pressure Pse in accordance with the value of the current supplied thereto and has the compressor operate at the minimum displacement at any value of the first suction pressure Pse. In this manner, a compressor equipped with the control valve 62 varies the cooling ability of the air conditioner.

When the inclination of the swash plate 32 is being controlled by adjusting the opening of the bleeding passage 61 by the second valve mechanism 82, the supply passage 58 is closed by the first valve mechanism 81. Therefore, refrigerant gas in the discharge chamber 48 is not supplied to the crank chamber 25 through the supply passage 58. Part of the refrigerant gas in the cylinder bores 21*a* is supplied to the crank chamber 25 via the clearance between the bores 21*a* and the pistons 45 as blowby gas. If the crank chamber 25 is supplied only with blowby gas, the amount of refrigerant gas in the crank chamber 25 decreases. In this state, when the opening of the bleeding passage 61 is being reduced by the second valve mechanism 82, the pressure in the crank chamber 25 may not be increased to a sufficient level. This hinders a quick change in the inclination of the swash plate 32.

However, in this preferred embodiment, the communicating passage 59, which has the fixed restriction 60 is provided between the discharge chamber 48 and the crank chamber 25. The passage 59 constantly supplies a predetermined amount of refrigerant gas to the crank chamber 25 from the discharge chamber 48. Therefore, even if the supply passage 58 is closed by the first valve mechanism 81 and the opening of the bleeding passage 61 is being controlled by the second valve mechanism 82, the pressure in the crank chamber 25 is maintained above a predetermined level. Thus, the inclination of the swash plate 32 is quickly changed in accordance with the control of the opening of the bleeding passage 61 by the second valve mechanism 82. This improves the response of the compressor when changing its displacement.

The swash plate 32 moves rearward an its inclination decreases. As it moves rearward, the awash plate 32 pushes the shutter 38 rearward through the thrust bearing 44. Accordingly, the shutter 38 moves toward the positioning surface 43 against the force of the coil spring 39. As the inclination of the swash plate 32 decreases, the shutter 38 continuously reduces the cross-sectional area of the passage between the suction passage 42 and the suction chamber 47. This continuously reduces the amount of refrigerant gas that enters the suction chamber 47 from the suction passage 42. The amount of refrigerant gas that is drawn into the cylinder bores 21*a* from the suction chamber 47 continuously decreases, accordingly. As a result, the displacement of the compressor continuously decreases. This continuously lowers the discharge pressure Pd of the compressor. The load torque of the compressor thus continuously decreases. In this manner, the load torque for operating the compressor does not change dramatically in a short time when the displacement decreases from the maximum to the minimum. The shock that accompanies load torque fluctuations is therefore lessened.

When the inclination of the swash plate 32 is minimum as illustrated in FIG. 4, the shutter 38 abuts against the positioning surface 43. The abutment prevents the inclination of the swash plate 32 from being smaller than the predetermined minimum inclination. The abutment also disconnects the suction passage 42 from the suction chamber 47. This stops the gas flow from the refrigerant circuit 65 to the suction chamber 47 thereby stopping the circulation of refrigerant gas between the circuit 65 and the compressor.

The minimum inclination of the swash plate 32 is slightly more than zero degrees. Zero degrees refers to the angle of the swash plate's inclination when it is perpendicular to the axis of the rotary shaft 26. Therefore, even if the inclination of the swash plate 32 is minimum, refrigerant gas in the cylinder bores 21*a* is discharged to the discharge chamber 48 and the compressor operates at the minimum displacement. The refrigerant gas discharged to the discharge chamber 48 from the cylinder bores 21*a* is then drawn into the crank chamber 25 through the supply passage 58. The refrigerant gas in the crank chamber 25 is drawn back into the cylinder bores 21*a* through the pressure release passage 56, the pressure release hole 57, the communication hole 55 and the suction chamber 47. That is, when the inclination of the swash plate 32 is minimum, refrigerant gas circulates within the compressor traveling through the discharge chamber 48, the supply passage 58, the crank chamber 25, the pressure release passage 56, the pressure release hole 57, the communication hole 55, the suction chamber 47 and the cylinder bores 21*a*. This circulation of refrigerant gas allows the lubricant oil contained in the gas to lubricate the moving parts of the compressor.

When the switch 73 is turned on and the inclination of the swash plate 32 is minimum, if the cooling load is increased in accordance with an increase in the compartment temperature, the compartment temperature detected by the sensor 72 becomes higher than a target temperature set by the temperature adjuster 71. The computer 70 commands the driver 75 to excite the solenoid mechanism 83 in accordance with the detected temperature increase. When the solenoid mechanism 83 is excited, the supply passage 58 is closed by the first valve mechanism 81 and the bleeding passage 61 is opened by the second valve mechanism 82. This allows the refrigerant gas in the crank chamber 25 to flow to the suction chamber 47 through the bleeding passage 61. This gradually lowers the pressure Pc in the crank chamber 25 thereby moving the swash plate 32 from the minimum inclination to the maximum inclination.

As the swash plate's inclination increases, the force of the spring 39 gradually pushes the shutter 38 away from the positioning surface 43. This gradually increases the cross-sectional area of the passage between the suction passage 42 to the suction chamber 47 thereby gradually increasing the amount of refrigerant gas flow from the suction passage 42 into the suction chamber 47. Therefore, the amount of refrigerant gas drawn into the cylinder bores 21*a* from the suction chamber 47 gradually increases. This allows the displacement of the compressor to gradually increase. Thus, the discharge pressure Pd of the compressor gradually increases and the torque needed for operating the compressor also gradually increases accordingly. In this manner, the load torque of the compressor does not change dramatically in a short time when the displacement increases from the minimum to the maximum. The shock that accompanies load torque fluctuations is therefore lessened.

If the engine E is stopped, the compressor is also stopped (that is, the rotation of the swash plate 32 is stopped). Also, the supply of current to the coil 110 in the valve 62 is stopped. This de-excites the solenoid 83 thereby causing the first valve mechanism 81 to open the supply passage 58 and the second valve mechanism 82 to close the bleeding passage 61. The inclination of the swash plate 32 is thus minimum.

If the nonoperational state of the compressor continues, the pressure in the chambers of the compressor become equalized and the swash plate 32 is kept at the minimum inclination by the force of spring 36. Therefore, when the engine E is started again, the compressor starts operating with the swash plate 32 at the minimum inclination. This requires the minimum torque. In this manner, the shock caused by starting the compressor is reduced.

As described above, the control valve 62 includes the first valve mechanism 61 for opening and closing the supply passage 58 and the second valve mechanism 82 for controlling the opening of the bleeding passage 61. The valve mechanisms 81, 82 are accommodated in the single housing 84. The preferred embodiment therefore has a simplified construction for controlling the displacement of the compressor compared to the prior art compressor, in which two kinds of valves are constructed independently and located separately in different positions in the compressor. The simplified construction reduces the manufacturing cost is of the compressor. Further, in the preferred embodiment, only the space for the single control valve 62 must be defined in the compressor. This facilitates the assembly of the valve 62 into the compressor and reduces the size of the compressor.

The first plunger 92 in the first valve mechanism 81 and the second plunger 101 in the second valve mechanism 82 are actuated by the common coil 110. That is, the single coil 110 is used for controlling both valve bodies 90, 102 in the valve mechanisms 81, 82. This simplifies the construction of the control valve 62. Further, both valve bodies 90, 102 in the valve mechanisms 81, 82 are simultaneously actuated in accordance with exciting and de-exciting of the coil 110.

In the mechanisms 81, 82, the valve bodies 90, 102 are coupled to the plungers 92, 101 by the rods 91, 100, respectively. The first rod 91 has a cylindrical shape and the second rod 100 is slidably inserted in the first rod 91. This construction allows the mechanisms 81, 82 to be aligned on the same axis. Further, the valve bodies 90, 102 can be arranged close to each other and the plungers 92, 101 can also be arranged close to each other. This construction reduces the size of the control valve 62 having the two valve mechanisms 81, 82.

When supply of current to the coil 110 is stopped, the second valve body 102 of the second valve mechanism 82 is moved in a direction closing the second valve hole 99 by the force of the closing spring 103. Therefore, when assembling the second valve mechanism 82, the second valve body 102 is pressed against the second valve hole 99 by the force of the spring 103. This facilitates the assembly of the control valve 62.

Figure 6:
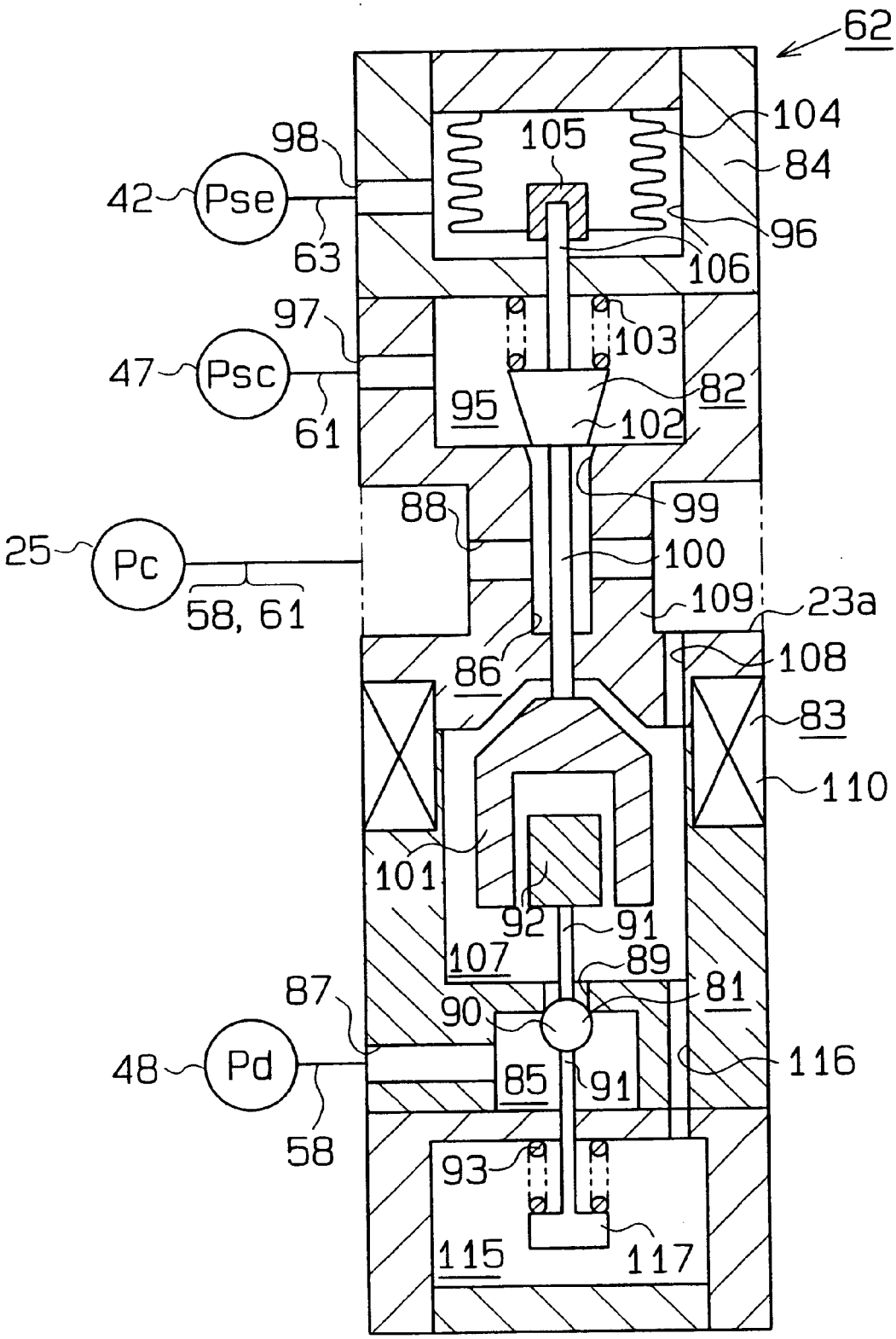
FIG. 6 is a cross-sectional view illustrating a control valve according to a second embodiment of the present invention when the solenoid of the valve is excited.
Figure 7:
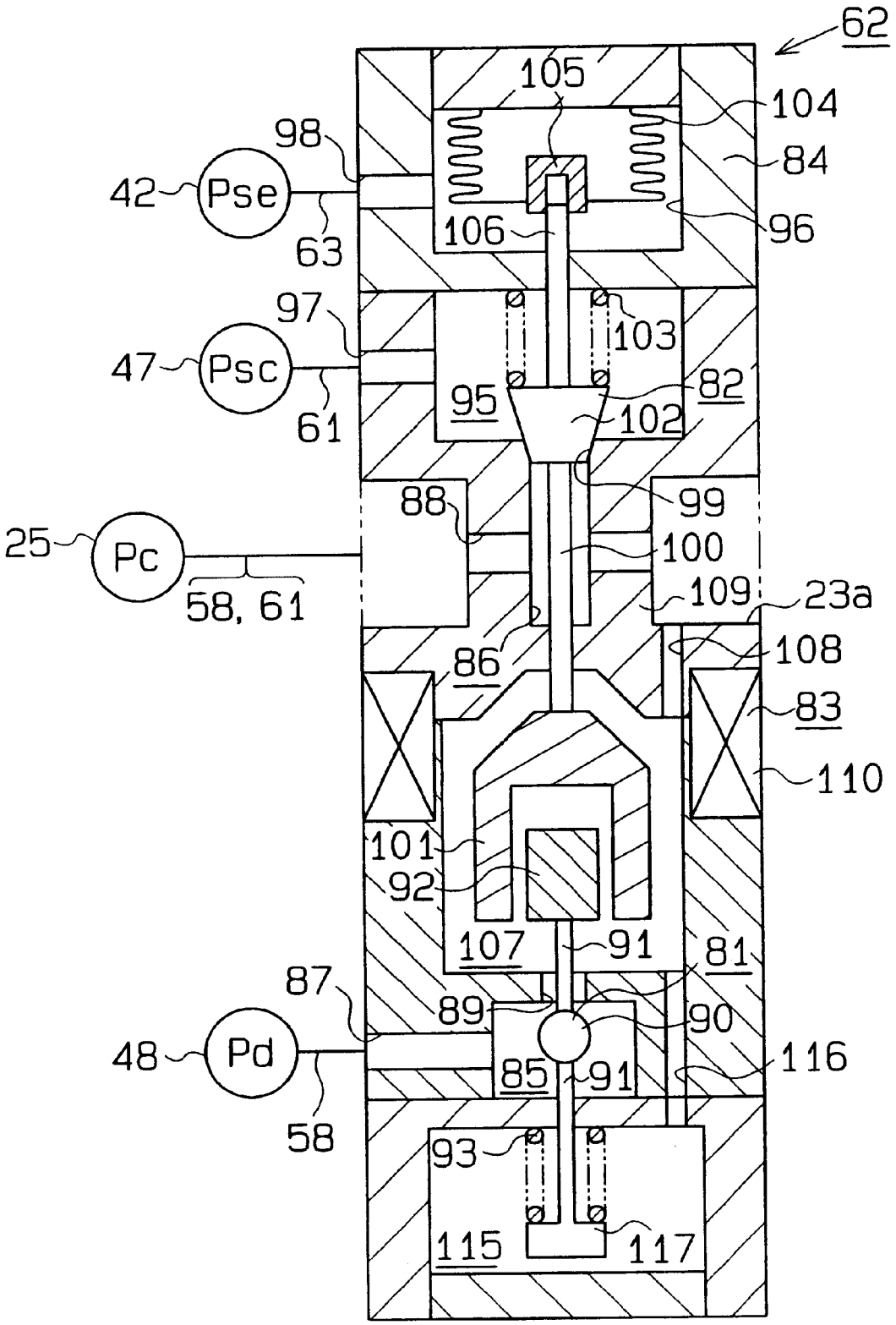
FIG. 7 is a cross-sectional view illustrating the control valve of FIG. 6 when the solenoid is de-excited.

A control valve 62 according to a second embodiment of the present invention will hereafter be described with reference to FIGS. 6 and 7. The differences from the first embodiment will mainly be discussed below.

In this embodiment, the first and second valve mechanisms 81, 82 are located on opposite sides of the solenoid mechanism 83. More specifically, the housing 84 includes a pressure sensing chamber 96, a second valve chamber 95 of a second valve mechanism 82, a communicating chamber 86, a solenoid chamber 107, a first valve chamber 85 of a first valve mechanism 81 and a spring chamber 115 (in order from top to bottom in FIGS. 6 and 7). The solenoid chamber 107 is communicated with the annular chamber 23*a* by a communicating hole 108. The spring chamber 115 is communicated with the solenoid chamber 107 by a communicating hole 116.

The first rod 91 of the first valve mechanism 81 has a spheric first valve body 90 located at its middle portion. A first plunger 92 and a spring receiver 117 are secured to both ends of the first rod 91, respectively. The axis of the first rod 91 is aligned with the axis of the second rod 100. The first rod 91 moves along the aligned axes. The first plunger 92 is arranged next to the second plunger 101 of the second valve mechanism 82 in the solenoid chamber 107. The spring receiver 117 is located in the spring chamber 115. An opening spring 93 is located between the spring receiver 117 and the inner wall of the spring chamber 115.

The control valve 62 of this preferred embodiment operates in substantially the same manner as the control valve 62 of the first embodiment. Specifically, when the solenoid mechanism 83 is excited, the first valve body 90 of the first valve mechanism 81 close the first valve hole 89 (that is, the supply passage 58). The second valve body 102 of the second valve mechanism 82 controls the opening of the second valve hole 99 (that is, the bleeding passage 61) in accordance with magnetic attractive force between the fixed core 109 and the second plunger 101 based on the value of current supplied to the coil 110 and with the first suction pressure Pse in the pressure sensing chamber 96. When the solenoid mechanism 83 is de-excited, on the other hand, the force of the opening spring 93 causes the first valve body 90 of the first valve mechanism 81 to open the first valve hole 89 (that is, the supply passage 58) as shown in FIG. 7. Further, the force of the closing spring 103 causes the second valve body 102 of the second valve mechanism 82 to close the valve hole 99 (the bleeding passage 61).

Therefore, the second embodiment has substantially the same advantageous effects as the first embodiment. Particularly in this embodiment, the rode 91, 100 of the valve mechanisms 81, 82 are separately arranged on aligned axes. This simplifies the structure for supporting the rods 91, 100 in the housing 84 thereby facilitating the manufacturing of the control valve 62.

A control valve 62 according to a third embodiment of the present invention will hereafter be described with reference to FIGS. 8 and 9. The differences from the first embodiment will mainly be discussed below.

Figure 8:
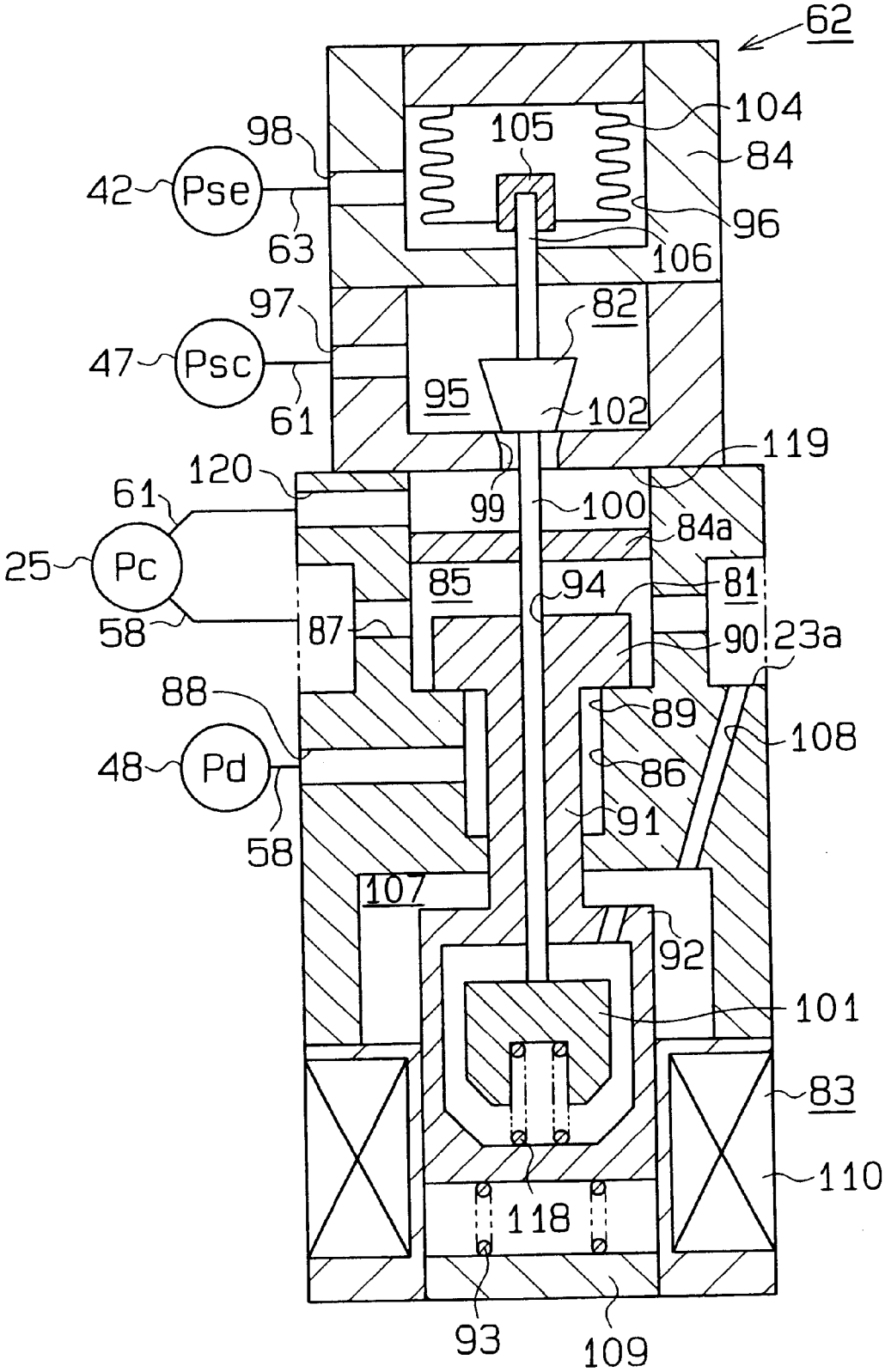
FIG. 8 is a cross-sectional view illustrating a control valve according to a third embodiment of the present invention when the solenoid is excited.
Figure 9:
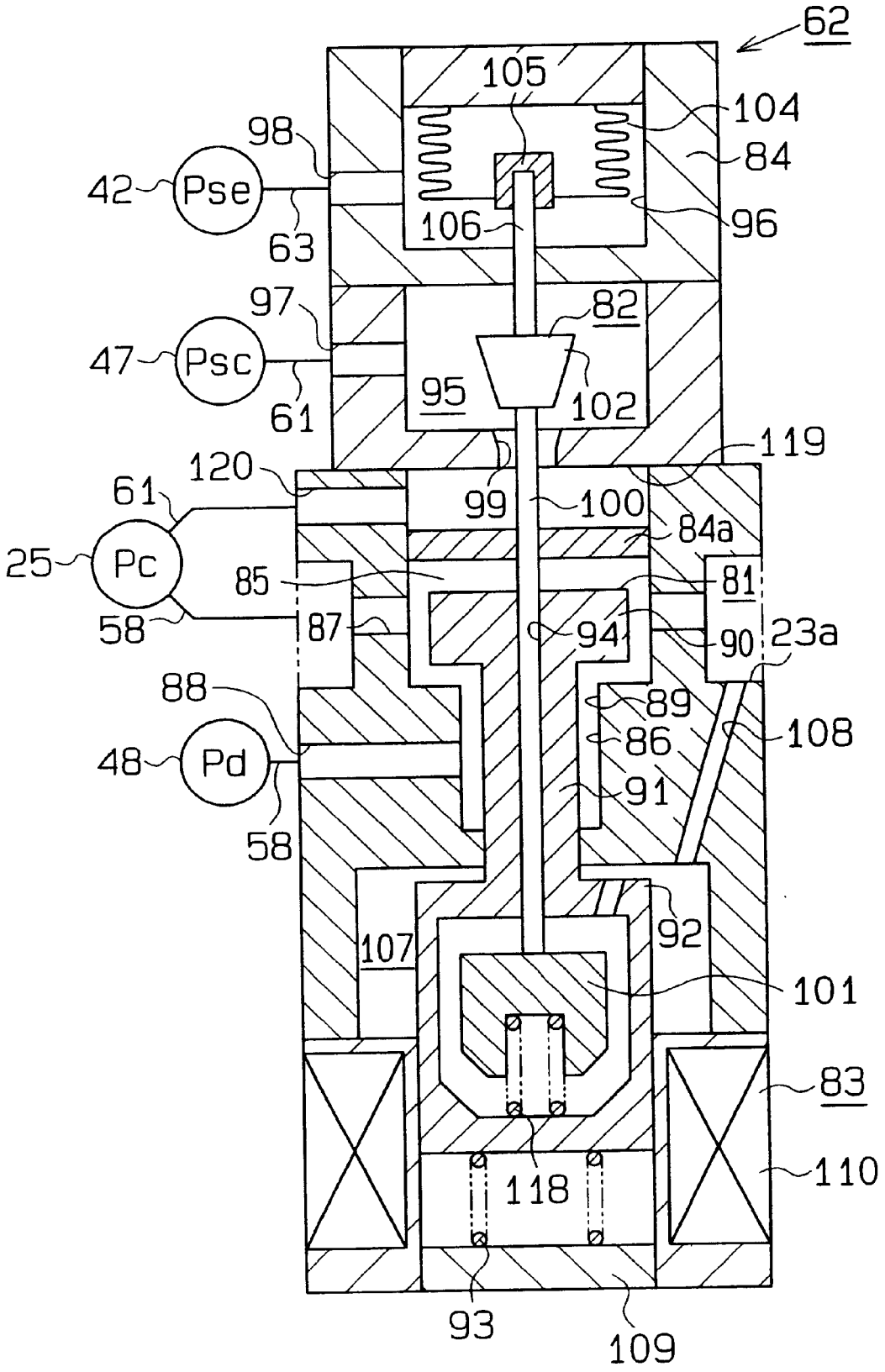
FIG. 9 is a cross-sectional view illustrating the control valve of FIG. 8 when the solenoid is de-excited.

The housing 84 of the valve 62 includes a pressure sensing chamber 96, a second valve chamber 95 of a second valve mechanism 82, a second communicating chamber 119, a first valve chamber 85 of a first valve mechanism 81, a communicating chamber 86 and a solenoid chamber 107 (in order from top to bottom in FIGS. 8 and 9). The first valve chamber 85 is connected to the crank chamber 25 by the supply port 87, the annular chamber 23*a* and the supply passage 58, which is independently formed from the bleeding passage 61. The solenoid chamber 107 is communicated with the annular chamber 23*a* by the communicating hole 108. Thus, the pressure in the annular chamber 23*a* (the crank chamber pressure Pc) is communicated with the solenoid chamber 107. The communicating chamber 86 is connected to the discharge chamber 48 by the communicating port 88 and the supply passage 58.

The second communicating chamber 119 is divided from the first valve chamber 85 by a bulkhead 84*a*. The second communicating chamber 119 is communicated with the second valve chasber 95 by the second valve hole 99. The second communicating chamber 119 is further communicated with the crank chamber 25 by the bleeding passage 61, which is independently formed from the supply passage 58. In this embodiment, the supply passage 58 and the bleeding passage 61, which communicate the crank chamber 25 with the control valve 62, are formed independently.

The first plunger 92 of the first valve mechanism 81 includes a hollow space defined therein. The second plunger 101 of the second valve mechanism 82 is movably accommodated in the space of the plunger 92. An opening spring 93 is located between the first plunger 92 and a fixed steel core 109. The spring 93 urges the first valve body 90 away from the first valve hole 89. A second opening spring 118 is located between the plungers 92, 101. The spring 118 urges the second valve body 102 away from the second valve hole 99.

When the solenoid mechanism 83 is excited, the control valve 62 of the third embodiment operates in substantially the same manner as the control valve 62 of the first embodiment. Specifically, exciting the solenoid mechanism 83 causes the first valve body 90 of the first valve mechanism 81 to close the first valve hole 99 (the supply passage 58) as shown in FIG. 8. The second valve body 102 of the second valve mechanism 82 controls the opening of the second valve hole 99 (the bleeding passage 61) in accordance with the magnetic attractive force between the first plunger 92 and the second plunger 101 based on the value of current supplied to the coil 110 and with the first suction pressure Pse in the pressure sensing chamber 96.

Unlike the first embodiment, the force urging the second valve body 102 in a direction closing the second valve hole 99 is increased as the attractive force between the first plunger 92 and the second plunger 101 increases. That is, increasing the value of current supplied to the coil 110 decreases the opening between the valve hole 99 and the valve body 102 and therefore decreases the displacement of the compressor. Thus, contrary to the first embodiment, the computer 70 commands the driver 75 to increase the current value to the coil 110 of the control valve 62 for a smaller cooling load.

As in the first embodiment, when the temperature sensor 69 detects a temperature that is lower than the frost forming temperature, or the switch 73 is turned off, the computer 70 commands the driver 75 to de-excite the solenoid 83. When the solenoid mechanism 83 is de-excited, the force of the opening spring 93 cause the first valve body 90 of the first valve mechanism 81 to open the first valve hole 89 (the supply passage 58). Further, the force of the second opening spring 118 causes the second valve body 102 of the second valve mechanism 82 to open the second valve hole 99 (the bleeding passage 61). When opened, the supply passage 58 supplies a significant amount of highly pressurized refrigerant gas in the discharge chamber 48 to the crank chamber 25. Therefore, even if the bleeding passage 61 is opened, the pressure Pc in the crank chamber 25 is increased. This minimizes the inclination of the swash plate 32 and the compressor thus operates at the minimum displacement.

The third embodiment also has substantially the same advantageous effects as the first embodiment. In this embodiment, stopping the current supplied to the coil 110 of the solenoid 83 causes the first valve mechanism 81 to open the supply passage 58 and the second valve mechanism 82 to open the bleeding passage 61. In other words when the compressor is operating at the minimum displacement, the bleeding passage 61 between the crank chamber 25 and the suction chamber 47 is also opened, as well as the supply passage 58. Thus, when the displacement of the compressor is minimum (in other words, when the inclination of the swash plate 32 is minimum), the bleeding passage 61 functions as a part of the circulation path of the refrigerant gas within the compressor.

A clutchless type variable displacement compressor includes a drive shaft 26 directly coupled to the external drive source such as the engine E and is operated with the minimum displacement even if refrigeration is not necessary. It is thus important to lubricate moving parts in the compressor during the minimum displacement operation. In a compressor provided with the control valve 62 of the third embodiment, refrigerant gas in the crank chamber 25 flows into the suction chamber 47 not only through the passage including the pressure release passage 56 and the pressure release hole 57, but also through the bleeding passage 61. Therefore, when the compressor is operated at the minimum displacement, lubricant contained in the refrigerant gas is smoothly circulated in the compressor and lubricates each moving part of the compressor. The control valve 62 of this preferred embodiment is thus suitable for clutchless type variable displacement compressors.

Figure 10:
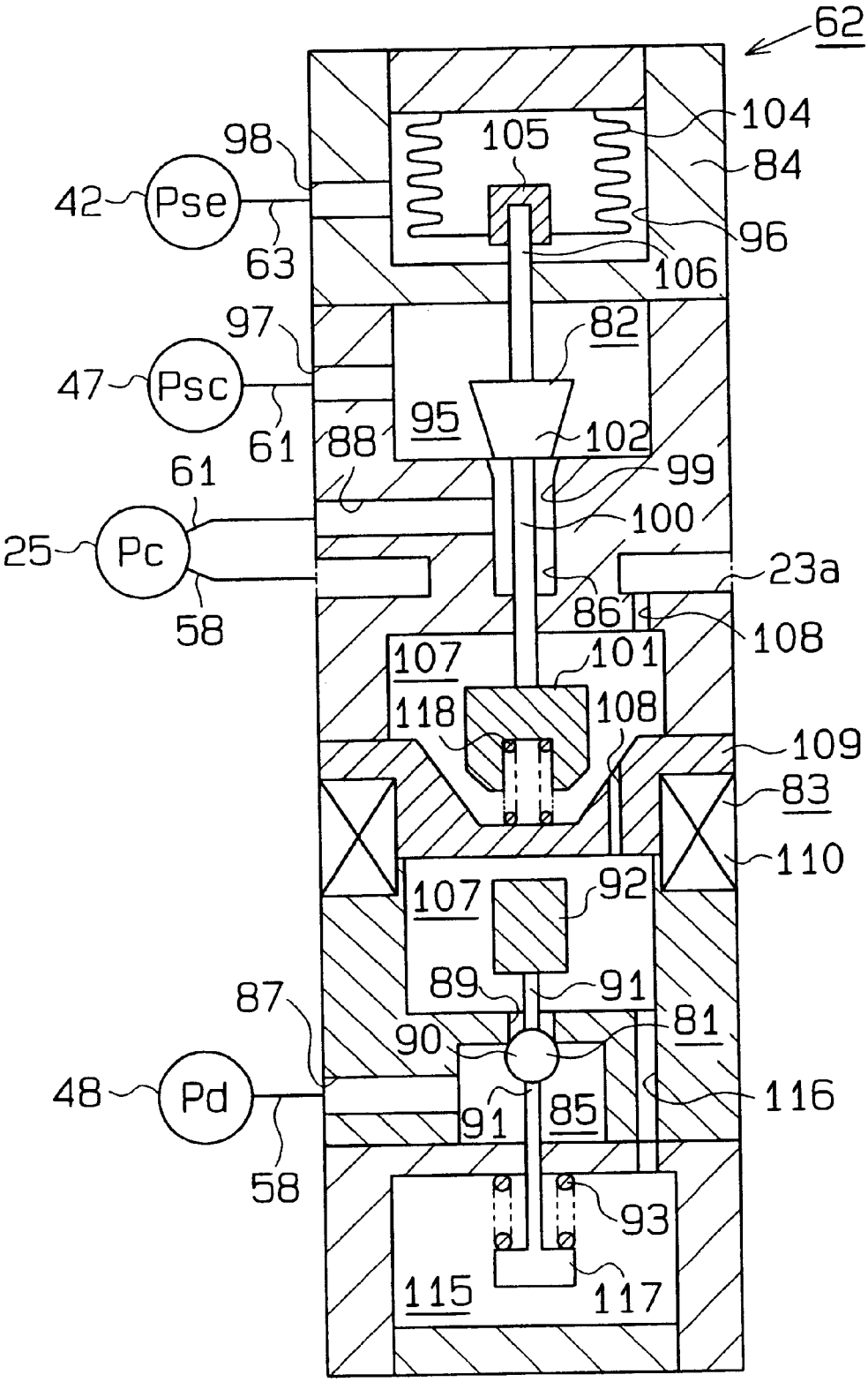
FIG. 10 is a cross-sectional view illustrating a control valve according to a fourth embodiment of the present invention when the solenoid is excited.
Figure 11:
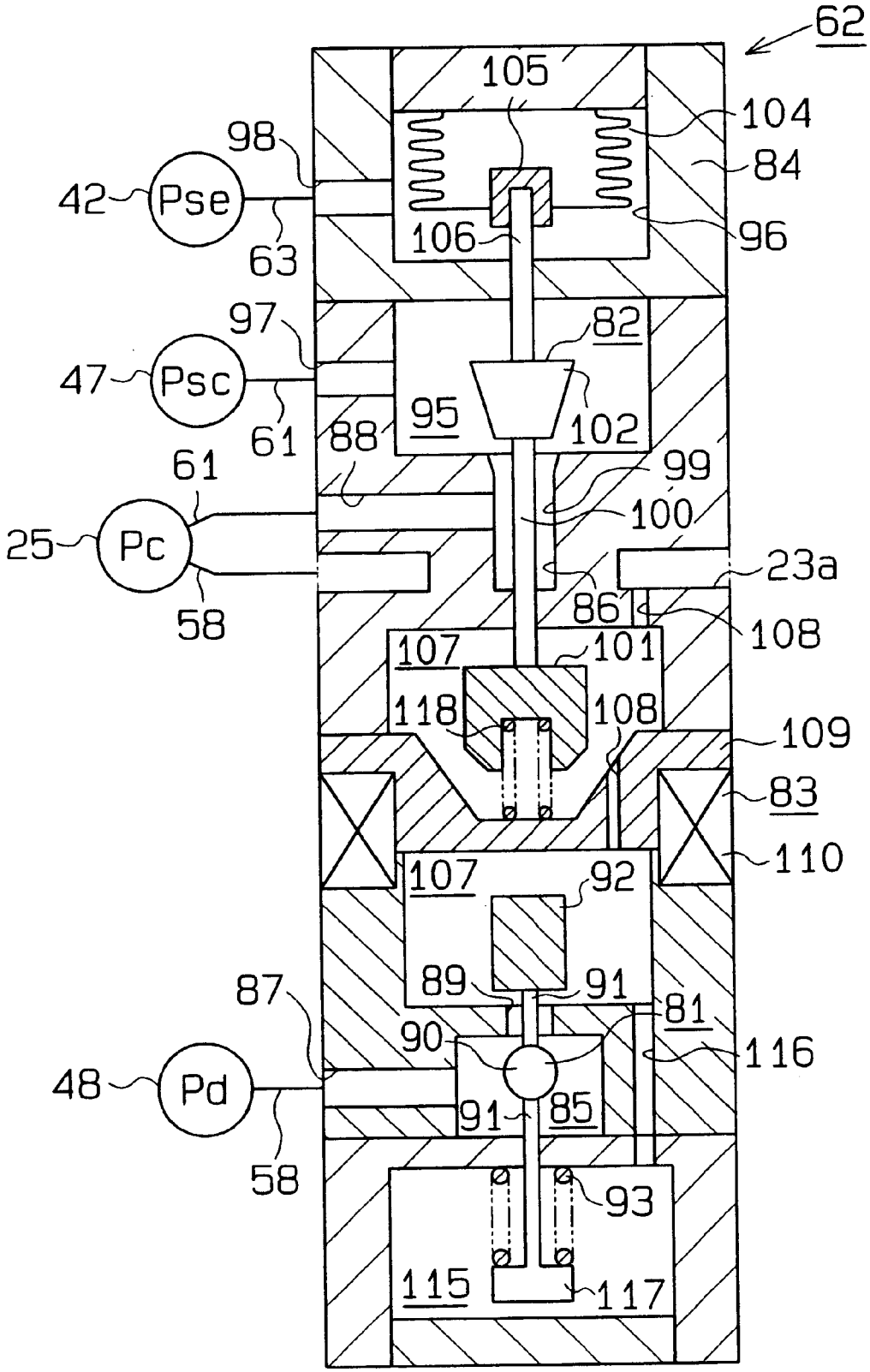
FIG. 11 is a cross-sectional view illustrating the control valve of FIG. 10 when the solenoid is de-excited.

A control valve 62 according to a fourth embodiment of the present invention will hereafter be described with reference to FIGS. 10 and 11. The differences from the first embodiment will mainly be discussed below.

Figure 12:
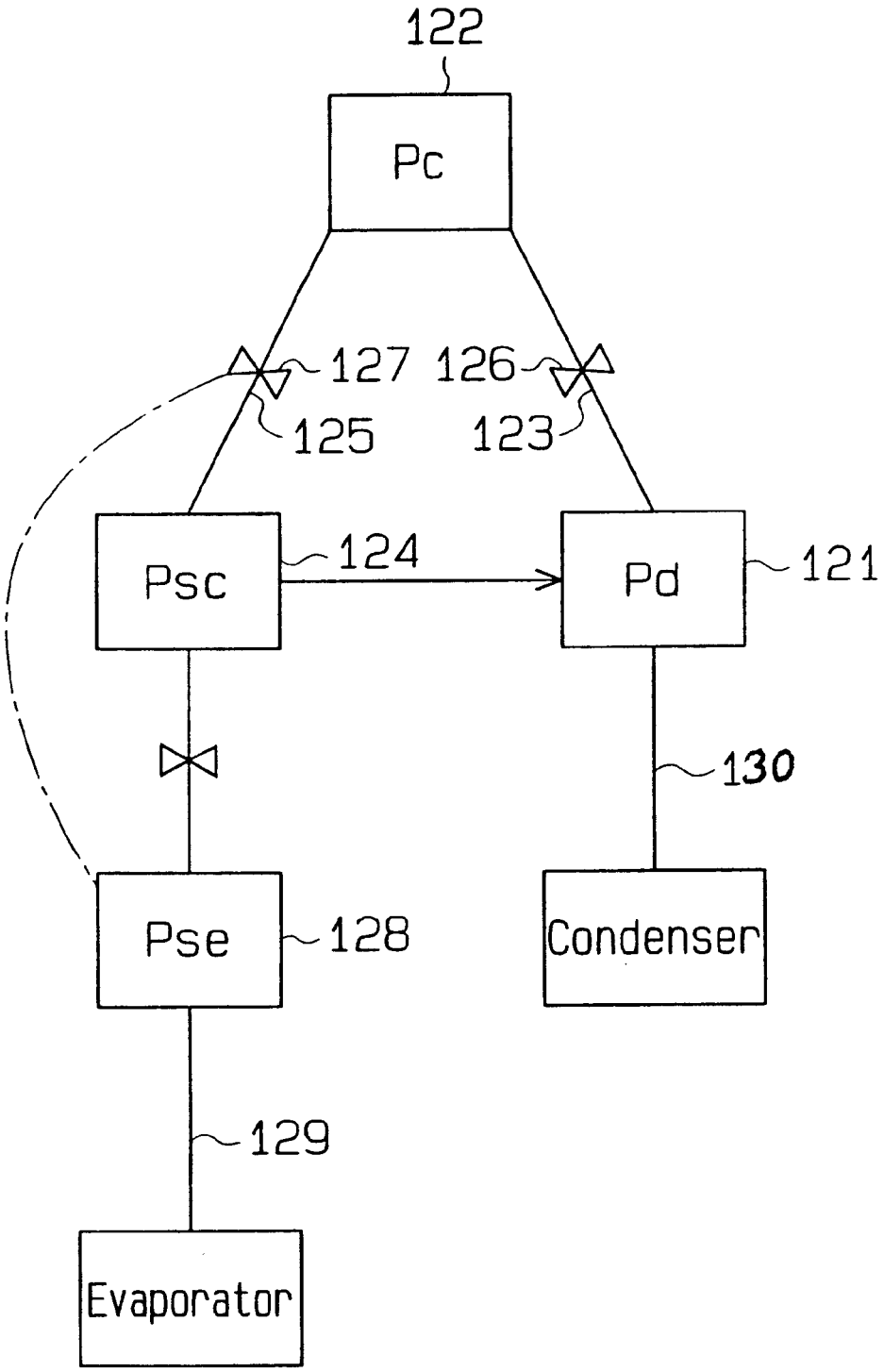
Fig.12 (Prior Art)
FIG. 12 is a diagram showing the flow of refrigerant gas in a prior art compressor.

As in the control valve 62 of the second embodiment, a first valve mechanism 81 and a second valve mechanism 82 are arranged on both sides of a solenoid mechanism 83 in the fourth embodiment. The housing 84 of the valve 62 includes a pressure sensing chamber 96, a second valve chamber 95 of the second valve mechanism 82, a communicating chamber 86, a pair of solenoid chambers 107, a first valve chamber 95 of the first valve mechanism 81 and a spring chamber 115 (in order from top to bottom in FIGS. 11 and 12). The solenoid chambers 107 are separated from each other by the fixed steel core 109. The solenoid chambers 107 are communicated with the crank chamber 25 by the communicating hole 108, the annular chamber 23*a* and the supply passage 58, which is independently formed from the bleeding passage 61. The spring chamber 115 is communicated with the lower solenoid chamber 107 by the communicating hole 116. The communicating chamber 86 is communicated with the crank chamber 25 by the communicating port 88 and the bleeding passage 61, which is formed independently from the supply passage 58. In this embodiment, as in the third embodiment, the supply passage 58 and the bleeding passage 61, which communicate the crank chamber 25 with the control valve 62, are formed independently.

The first rod 91 of the first valve mechanism 81 has a spheric first valve body 90 located at its middle portion. A first plunger 92 and a spring receiver 117 are secured to both ends of the first plunger 92, respectively. The axis of the first rod 91 is aligned with the axis of the second rod 100. The first rod 91 moves along the aligned axes. The first plunger 92 is arranged in the lower solenoid chamber 107. The second plunger 101 is arranged in the upper solenoid chamber 107. The plungers 92, 101 face each other with the fixed core 109 in between.

The spring receiver 117 is located in the spring chamber 115. An opening spring 93 is located between the spring receiver 117 and the inner wall of the spring chamber 115. The opening spring 93 urges the first valve body 90 away form the first valve hole 89. A second opening spring 118 is located between the second plunger 101 and the core 109. The spring 118 urges the second valve body 102 away from the second valve hole 99.

The above described control valve 62 of the fourth embodiment operates in substantially the same manner as the control valve 62 of the third embodiment. When the solenoid 83 is excited, the first valve body 90 of the first valve mechanism 81 closes the first valve hole 89 (the supply passage 58) as shown in FIG. 10. The second valve body 102 of the second valve mechanism 82 controls the opening of the second valve hole 99 (the bleeding passage 61) in accordance with the magnetic attractive force between the core 109 and the second plunger 101 based on the value of current supplied to the coil 110 and with the first suction pressure Pse in the pressure sensing chamber 96.

As in the third embodiment, the force urging the second valve body 102 in a direction closing the second valve hole 99 is increased as the attractive force between the core 109 and the second plunger 101 increases. Thus, as in the third embodiment, the computer 70 commands the driver 75 to increase the current value to the coil 110 of the control valve 62 for a smaller cooling load.

When the temperature sensor 69 detects a temperature that is lower than the frost forming temperature, or the switch 73 is turned off, the computer 70 commands the driver 75 to de-excite the solenoid 83 as in the third embodiment. When the solenoid mechanism 83 is de-excited, the force of the opening spring 93 causes the first valve body 90 of the first valve mechanism 81 to open the first valve hole 89 (the supply passage 58) as shown in FIG. 11. Further, the force of the second opening spring 118 causes the second valve body 102 of the second valve mechanism 82 to open the second valve hole 99 (the bleeding passage 61). This minimizes the inclination of the swash plate 32, as in the third embodiment, and thus the compressor operates at the minimum displacement.

The fourth embodiment has substantially the same advantageous effect as the third embodiment. Particularly in this embodiment, the rods 91, 100 of the valve mechanisms 81, 82 are separately arranged on the aligned axes. This simplifies the structure for supporting the rods 91, 100 in the housing 84, as in the second embodiment, thereby facilitating the manufacturing of the control valve 62.

The present invention may alternatively embodied as follows:

In the first and third embodiment, the second rod 100 of the second valve mechanism 82 may have a cylindrical shape and the first rod 91 of the first valve mechanism 81 may be slidably inserted in the second rod 100.

In the above embodiments, the solenoid chamber 107 and the spring chamber 115 are communicated with the crank chamber 25 by the communicating holes 108, 116, the annular chamber 23*a* and the supply passage 58. However, the chambers 107, 115 may be communicated with the crank chamber 25 by other routes. For example, a port may be formed in the housing 84 at a position corresponding to the chambers 107, 115 and the port may be connected to the supply passage 58. In this case, the pressure Pc in the crank chamber 25 is introduced to the chambers 107, 115 by the supply passage 58 and the port.

The control valve 62 according to the present invention may be employed in a compressor having a drive shaft 26 that is connected to an external drive source E by a clutch.

Therefore, the present examples and embodiments are to be considered as illustrative and not restrictive and the invention is not to be limited to the details given herein, but may be modified within the scope and equivalence of the appended claims.

What is claimed is:

1. A control valve in a variable displacement compressor that adjusts the discharge displacement based on controlling inclination of a drive plate located in a crank chamber, wherein the compressor includes a piston operably coupled to the drive plate and located in a cylinder bore, wherein the piston compresses gas supplied to the cylinder bore from a suction chamber and discharges the compressed gas to a discharge chamber from the cylinder bore, wherein the inclination of the drive plate is variable based on the pressure in the crank chamber, wherein a supply passage connects the discharge chamber with the crank chamber to supply the gas from the discharge chamber to the crank chamber, and wherein a bleeding passage connects the crank chamber with the suction chamber to release the gas from the crank chamber to the suction chamber, the control valve comprising:

a single housing;

a first valve mechanism retained in the housing to selectively open and close the supply passage, wherein the first valve mechanism has a first valve hole defined in the housing to be located in the supply passage, a first valve body for selectively opening and closing the first valve hole, and a first plunger connected to the first valve body;

a second valve mechanism retained in the housing to adjust the flow rate of the gas released from the crank chamber to the suction chamber through the bleeding passage, wherein the second valve mechanism has a second valve hole defined in the housing to be located in the bleeding passage, a second valve body for adjusting the opening size of the second valve hole, and a second plunger connected to the second valve body, wherein the first valve mechanism and the second valve mechanism operate independently; and a single solenoid mechanism retained in the housing, wherein the solenoid mechanism is selectively excited and de-excited based on a supply of current to independently actuate the first valve mechanism and the second valve mechanism, wherein the solenoid mechanism has a fixed core and a coil, the first plunger and the second plunger are adjacent to the fixed core to move toward or away from the fixed core, and the current supplied to the coil produces a magnetic attractive force for independently biasing the first and second plungers in accordance with the value of the current to independently actuate the first and second valve bodies.

2. The control valve according to claim 1, wherein the housing has a portion that is exposed to the outside of the compressor when the control valve is installed in the compressor for facilitating electrical connections, wherein the solenoid mechanism is adjacent to the exposed portion.

3. The control valve according to claim 1, wherein the first valve body is movable along an axis, the first valve body moving in one axial direction to open the first valve hole and moving in the opposite direction to close the first valve hole, wherein the second valve body is movable along the axis in one direction to adjustably open the second valve hole and in the opposite direction to adjustably close the second valve hole, wherein the solenoid mechanism independently biases the first valve body to close the first valve hole and independently biases the second valve body with a force based on a value of the current supplied to the coil when the solenoid mechanism is excited by the supply of the current, and wherein the second valve mechanism has a pressure sensing member for reacting to the pressure of the gas supplied to the compressor, the pressure sensing member serving to move the second valve body in accordance with the pressure of the gas supplied to the compressor.

4. The control valve according to claim 3, wherein the first valve mechanism has a first urging means for urging the first valve body to open the first valve hole when the solenoid mechanism is de-excited, and wherein the second valve mechanism has a second urging means for urging the second valve body to close the second valve hole when the solenoid mechanism is de-excited.

5. The control valve according to claim 4, wherein the solenoid mechanism biases the second valve body in a direction to open the second valve hole when the solenoid mechanism is excited, wherein the pressure sensing member moves the second valve body in the same direction in accordance with an increase in the pressure of the gas supplied to the compressor, wherein the second valve mechanism has a coupling member for coupling the second valve body to the pressure sensing member such that the distance between the second valve body and the pressure sensing member is changeable, and wherein the coupling member allows the second valve body to close the second valve hole by the urging force of the second urging means.

6. The control valve according to claim 3, wherein the first valve mechanism has a first urging means for urging the first valve body to open the first valve hole when the solenoid mechanism is de-excited, and wherein the second valve mechanism has a third urging means for urging the second valve body to open the second valve hole when the solenoid mechanism is de-excited.

7. The control valve according to claim 1, wherein the first valve mechanism has a first rod for connecting the first valve body to the first plunger, wherein the second valve mechanism has a second rod for connecting the second valve body to the second plunger, and wherein the first and second rods are coaxially arranged for independent operation.

8. The control valve according to claim 1, wherein the first valve mechanism has a first rod for connecting the first valve body to the first plunger and a first valve chamber defined in the housing to accommodate the first valve body, wherein the first valve chamber is connected with the first valve hole, wherein the solenoid mechanism is located on an opposite side of the first valve chamber from the first valve hole, wherein one of the discharge chamber and the crank chamber is connected with the first valve chamber by the supply passage, and the other is connected with the first valve hole by the supply passage, and wherein the first rod has a cross-sectional area that is substantially equal to the cross-sectional area of the first valve hole.

9. The control valve according to claim 1, wherein the compressor comprises a communicating passage for connecting the discharge chamber with the crank chamber to constantly supply the gas from the discharge chamber to the crank chamber, wherein the communicating passage has a fixed restriction for restricting the flow of the gas in the communicating passage to a predetermined flow rate.

10. A control valve in a variable displacement compressor that adjusts the discharge displacement based on control of an inclination of a drive plate located in a crank chamber, wherein the inclination of the drive plate is variable based on the pressure in the crank chamber, wherein the compressor includes a piston operably coupled to the drive plate and located in a cylinder bore such that the piston compresses gas supplied to the cylinder bore from a suction chamber and discharges the compressed gas to a discharge chamber from the cylinder bore, a supply passage from connecting the discharge chamber with the crank chamber to supply the gas from the discharge chamber to the crank chamber, and a bleeding passage for connecting the crank chamber with the suction chamber to release the gas from the crank chamber to the suction chamber, the control valve comprising:

a housing;

a first valve mechanism located in the housing to selectively open and close the supply passage, wherein the first valve mechanism has a first valve hole defined in the housing and located in the supply passage, a first valve body for selectively opening and closing the first valve hole and a first plunger connected to the first valve body;

a second valve mechanism located in the housing to adjust the flow rate of the gas released from the crank chamber to the suction chamber through the bleeding passage, wherein the second valve mechanism has a second valve hole defined in the housing and located in the bleeding passage, a second valve body for adjusting the opening size of the second valve hole, a second plunger connected to the second valve body, and a pressure sensing member for moving the second valve body in accordance with the pressure of the gas supplied to the compressor, wherein the first valve mechanism and the second valve mechanism operate independently; and a solenoid mechanism located in the housing, wherein the solenoid mechanism is selectively excited and de-excited based on a supply of electric current to independently actuate the first valve body and the second valve body, wherein the solenoid mechanism has a fixed core and a coil, wherein the first plunger and the second plunger are adjacent to the fixed core to move toward or away from the fixed core, and wherein the current supplied to the coil produces a magnetic attractive force for independently biasing the first and second plungers in accordance with the value of the current to independently actuate the first and second valve bodies.

11. The control valve according to claim 10, wherein the compressor comprises a communicating passage for connecting the discharge chamber with the crank chamber to constantly supply the gas from the discharge chamber to the crank chamber, wherein the communicating passage has a fixed restriction for restricting the flow of the gas in the communicating passage to a predetermined flow rate.

12. The control valve according to claim 10, wherein the first valve body is movable along an axis, the first valve body moving in one axial direction to open the first valve hole and moving in the opposite direction to close the first valve hole, wherein the second valve body is movable along the axis in one direction to adjustably open the second valve hole and in the opposite direction to adjustably close the second valve hole, and wherein the solenoid mechanism independently biases the first valve body to close the first valve hole and biases the second valve body with a force based on a value of the current supplied to the solenoid mechanism when the solenoid mechanism is excited by the supply of the current.

13. The control valve according to claim 12, wherein the housing has a portion that is exposed to the outside of the compressor when the control valve is installed in the compressor for facilitiating electrical connections, wherein the solenoid mechanism is adjacent to the exposed portion.

14. The control valve according to claim 10, wherein the first valve mechanism has a first urging means for urging the first valve body to open the first valve hole when the solenoid mechanism is de-excited, and wherein the second valve mechanism has a second urging means for urging the second valve body to close the second valve hole when the solenoid mechanism is de-excited.

15. The control valve according to claim 14, wherein the solenoid mechanism biases the second valve body in a direction to open the second valve hole when the solenoid mechanism is excited, wherein the pressure sensing member moves the second valve body in the same direction in accordance with an increase in the pressure of the gas supplied to the compressor, wherein the second valve mechanism has a coupling member for coupling the second valve body to the pressure sensing member such that the distance between the second valve body and the pressure sensing member is changeable, and wherein the coupling member allows the second valve body to close the second valve hole by the urging force of the second urging means.

16. The control valve according to claim 10, wherein the first valve mechanism has a first urging means for urging the first valve body to open the first valve hole when the solenoid mechanism in de-excited, and wherein the second valve mechanism has a third urging means for urging the second valve body to open the second valve hole when the solenoid mechanism is de-excited.

17. The control valve according to claim 10, wherein the first valve mechanism has a first rod for connecting the first valve body to the first plunger, wherein the second valve mechanism has a second rod for connecting the second valve body to the second plunger, and wherein the first and second rods are coaxially arranged for independent operation.

18. The control valve according to claim 17, wherein the first valve mechanism has a first valve chamber defined in the housing to accommodate the first valve body, wherein the first valve chamber is connected with the first valve hole, wherein the solenoid mechanism is located on an opposite side of the first valve chamber from the first valve hole, wherein one of the discharge chamber and the crank chamber is connected with the first valve chamber by the supply passage, and the other is connected with the first valve hole by the supply passage, and wherein the first rod has a cross-sectional area that is substantially equal to the cross-sectional area of the first valve hole.

* * * * *

UNITED STATES PATENT AND TRADEMARK OFFICE

CERTIFICATE OF CORRECTION

PATENT NO. : 6,010,312
DATED : January 4, 2000
INVENTOR(S) : Ken Suitou et al.

It is certified that error appears in the above-identified patent and that said Letters Patent is hereby corrected as shown below:

Title page,
First column, at "[75] Inventors:", line 3, after "Kariya," insert -- Aichi, --;
"[73] Assignee:", line 2, change "Seiksakusho" to -- Seisakusho -- and "Aichi-ken" to -- Kariya, Aichi --.

Column 1,
Line 47, change "awash" to -- swash --.

Column 2,
Line 18, change "auction" to -- suction --.

Column 3,
Line 28, after "32" change "i" to -- is --;
Line 65, change "diamneter" to -- diameter --.

Column 4,
Line 3, change "auction" to -- suction --;
Line 14, change "pasage" to -- passage --.

Column 5,
Line 44, change "issue" to -- issues --.

Column 6,
Line 46, change "chamner" to -- chamber -- and change "94" to -- 84 --;
Line 48, change "auction" to -- suction --.

UNITED STATES PATENT AND TRADEMARK OFFICE

CERTIFICATE OF CORRECTION

PATENT NO. : 6,010,312
DATED : January 4, 2000
INVENTOR(S) : Ken Suitou et al.

It is certified that error appears in the above-identified patent and that said Letters Patent is hereby corrected as shown below:

Column 11,
Line 16, change "an" to -- as --;
Line 17, change "awash" to -- swash --.

Column 12,
Line 44, change "pressure" to -- pressures --;
Line 61, after "cost" delete "is".

Column 14,
Line 7, change "rode" to -- rods --;
Line 36, change "chasber" to -- chamber --;
Line 58, change "99" to -- 89 --.

Column 20,
Line 29, after "and" insert -- independently --;
Line 37, change "facilitiating" to -- facilitating --;
Line 62, change "in" to -- is --.

Signed and Sealed this

Ninth Day of October, 2001

*Attest:*

Nicholas P. Godici

*Attesting Officer*

NICHOLAS P. GODICI
*Acting Director of the United States Patent and Trademark Office*